US007309065B2

(12) United States Patent
Yoseloff et al.

(10) Patent No.: US 7,309,065 B2
(45) **Date of Patent: *Dec. 18, 2007**

(54) INTERACTIVE SIMULATED BACCARAT SIDE BET APPARATUS AND METHOD

(75) Inventors: Mark L. Yoseloff, Henderson, NV (US); R. Brooke Dunn, Henderson, NV (US); Philip S. Smith, Las Vegas, NV (US); Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 299 days.

This patent is subject to a terminal disclaimer.

(21) Appl. No.: 10/940,251

(22) Filed: Sep. 14, 2004

(65) Prior Publication Data

US 2005/0073102 A1 Apr. 7, 2005

Related U.S. Application Data

(63) Continuation-in-part of application No. 10/764,827, filed on Jan. 26, 2004, which is a continuation-in-part of application No. 10/310,616, filed on Dec. 4, 2002, now Pat. No. 6,789,801.

(51) Int. Cl.
*A63F 1/00* (2006.01)

(52) U.S. Cl. ..... 273/292; 463/13

(58) Field of Classification Search ..... 463/11
See application file for complete search history.

(56) References Cited

U.S. PATENT DOCUMENTS

| | | | |
|---|---|---|---|
| 3,595,987 | A | 7/1971 | Vlahos |
| 4,007,487 | A | 2/1977 | Vlahos |
| 4,026,555 | A | 5/1977 | Kirschner et al. |
| 4,100,569 | A | 7/1978 | Vlahos |
| 4,344,085 | A | 8/1982 | Vlahos |
| 4,397,509 | A | 8/1983 | Miller et al. |
| 4,445,114 | A | 4/1984 | Stubben |
| 4,508,353 | A | 4/1985 | Meyer et al. |
| 4,530,499 | A | 7/1985 | Breslow et al. |
| 4,614,342 | A | 9/1986 | Takashima |
| 4,643,421 | A | 2/1987 | Meyer et al. |

(Continued)

FOREIGN PATENT DOCUMENTS

| | | |
|---|---|---|
| JP | 2660586 | 6/1997 |

(Continued)

OTHER PUBLICATIONS

Scame's Encyclopedia of Card Games by John Scame, Copyright © 1973, 1983, pp. 292-304, "Chemin De Fer" (Baccarat).

(Continued)

*Primary Examiner*—Eugene Kim
*Assistant Examiner*—Dolores R. Collins
(74) *Attorney, Agent, or Firm*—Mark A. Litman & Associates, PA

(57) ABSTRACT

A multi-player automated casino table card game platform enables play of casino table baccarat-type games according to rules effected through a processor. Rules may include games similar to Baccarat or Mini Baccarat with an optional side bet on a point spread between the player and bank hands.

26 Claims, 11 Drawing Sheets

U.S. PATENT DOCUMENTS 4,658,427 A 4/1987 Aubin
4,667,959 A 5/1987 Pfeiffer et al.
4,687,200 A 8/1987 Shirai
4,724,307 A 2/1988 Dutton et al.
4,738,451 A 4/1988 Logg
4,807,884 A 2/1989 Breeding
4,836,553 A 6/1989 Suttle et al.
4,861,041 A 8/1989 Jones et al.
4,887,819 A 12/1989 Walker
4,926,327 A 5/1990 Sidley
4,995,615 A 2/1991 Cheng
5,000,453 A 3/1991 Stevens et al.
5,090,708 A 2/1992 Gerlitz et al.
5,120,057 A 6/1992 Kitaue
5,125,671 A 6/1992 Ueda et al.
5,149,104 A 9/1992 Edelstein
5,150,899 A 9/1992 Kitaue
5,159,549 A 10/1992 Hallman, Jr. et al.
5,221,083 A 6/1993 Dote
5,288,078 A 2/1994 Capper et al.
5,317,505 A 5/1994 Karabed et al.
5,356,145 A 10/1994 Verschoor
5,362,064 A 11/1994 Lofink et al.
5,374,061 A 12/1994 Albrecht
5,414,256 A 5/1995 Gurner et al.
5,453,758 A 9/1995 Sato
5,470,080 A 11/1995 Naka et al.
5,513,850 A 5/1996 Vancura
5,521,616 A 5/1996 Capper et al.
5,529,309 A 6/1996 Bartlett
5,586,766 A 12/1996 Forte et al.
5,586,936 A 12/1996 Bennett et al.
5,605,334 A 2/1997 McCrea, Jr.
5,616,078 A 4/1997 Oh
5,669,816 A 9/1997 Garczynski et al.
5,673,917 A 10/1997 Vancura
5,676,372 A * 10/1997 Sines et al. ..... 273/149 R
5,681,039 A 10/1997 Miller
5,683,085 A 11/1997 Johnson et al.
5,688,174 A 11/1997 Kennedy
5,695,189 A 12/1997 Breeding et al.
5,722,893 A 3/1998 Hill et al.
5,726,706 A 3/1998 Walsh
5,735,742 A 4/1998 French
5,745,166 A 4/1998 Rhodes et al.
5,779,546 A 7/1998 Meissner et al.
5,781,647 A 7/1998 Fishbine et al.
5,794,964 A 8/1998 Jones et al.
5,803,453 A 9/1998 Stephan et al.
5,806,854 A 9/1998 Coleman et al.
5,820,460 A 10/1998 Fulton
5,831,527 A 11/1998 Jones, II et al.
5,857,678 A 1/1999 Coleman et al.
5,879,235 A 3/1999 Kaneko et al.
5,897,235 A 4/1999 Honma
5,919,090 A 7/1999 Mothwurf
5,923,364 A 7/1999 Rhodes et al.
5,934,998 A 8/1999 Forte et al.
5,941,769 A 8/1999 Order
5,944,310 A 8/1999 Johnson et al.
5,961,121 A 10/1999 Brown
5,976,019 A 11/1999 Ikeda et al.
6,019,368 A * 2/2000 Sines et al. ..... 273/149 R
6,039,650 A 3/2000 Hill
6,068,258 A 5/2000 Breeding et al.
6,093,103 A 7/2000 McCrea, Jr.
6,117,012 A 9/2000 McCrea, Jr.
6,126,166 A 10/2000 Lorson et al.
6,139,014 A 10/2000 Breeding et al.
6,149,154 A 11/2000 Grauzer et al.
6,154,131 A 11/2000 Jones, II et al.
6,165,069 A 12/2000 Sines et al.
6,179,291 B1 1/2001 Vancura
6,217,447 B1 4/2001 Lofink et al.
6,227,969 B1 5/2001 Yoseloff
6,250,632 B1 6/2001 Albrecht
6,254,096 B1 7/2001 Grauzer et al.
6,267,248 B1 7/2001 Johnson et al.
6,270,404 B2 * 8/2001 Sines et al. ..... 463/12
6,273,424 B1 8/2001 Breeding
6,279,910 B1 8/2001 de Keller
6,293,864 B1 9/2001 Romero
6,296,251 B1 10/2001 Webb
6,299,531 B1 10/2001 Bommarito
6,299,536 B1 10/2001 Hill
6,313,871 B1 11/2001 Schubert
6,325,373 B1 12/2001 Breeding et al.
6,345,824 B1 2/2002 Selitzky
6,361,044 B1 3/2002 Block et al.
6,390,474 B1 5/2002 Terminel et al.
6,394,898 B1 5/2002 Nagao et al.
6,403,908 B2 6/2002 Stardust et al.
6,416,406 B1 * 7/2002 Duhamel ..... 463/12
6,460,848 B1 10/2002 Soltys et al.
6,466,220 B1 10/2002 Cesana et al.
6,469,747 B1 10/2002 Rai et al.
6,517,435 B2 2/2003 Soltys et al.
6,517,436 B2 2/2003 Soltys et al.
6,519,283 B1 2/2003 Cheney et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,568,678 B2 5/2003 Breeding et al.
6,579,180 B2 6/2003 Soltys et al.
6,579,181 B2 6/2003 Soltys et al.
6,588,751 B1 7/2003 Grauzer et al.
6,595,857 B2 7/2003 Soltys et al.
6,607,443 B1 * 8/2003 Miyamoto et al. ..... 463/40
6,629,894 B1 10/2003 Purton
6,638,161 B2 10/2003 Soltys et al.
6,651,981 B2 11/2003 Grauzer et al.
6,651,982 B2 11/2003 Grauzer et al.
6,651,985 B2 * 11/2003 Sines et al. ..... 273/309
6,652,379 B2 11/2003 Soltys et al.
6,655,684 B2 12/2003 Grauzer et al.
6,658,750 B2 12/2003 Scheibner et al.
6,661,425 B1 12/2003 Hiroaki
6,663,490 B2 12/2003 Soltys et al.
6,789,801 B2 * 9/2004 Snow ..... 273/292
6,808,173 B2 * 10/2004 Snow ..... 273/292
6,874,786 B2 * 4/2005 Bruno et al. ..... 273/306
6,960,134 B2 * 11/2005 Hartl et al. ..... 463/20
7,048,629 B2 * 5/2006 Sines et al. ..... 463/16
7,108,265 B1 * 9/2006 Dargue ..... 273/292
2002/0169013 A1 11/2002 Serizawa et al.
2003/0199316 A1 10/2003 Miyamoto et al.

FOREIGN PATENT DOCUMENTS

WO WO 00/30856 6/2000
WO WO 00/51076 8/2000

OTHER PUBLICATIONS

Gaming Concepts Over/Under 13.

* cited by examiner

INTERACTIVE SIMULATED BACCARAT SIDE BET APPARATUS AND METHOD

RELATED APPLICATION DATA

This Application is a continuation-in-part of U.S. patent application Ser. No. 10/310,616, filed Dec. 4, 2002, now U.S. Pat. No. 6,789,801. This Application is also a continuation-in-part of U.S. patent applications Ser. No. 10/764,827; 10/764,994; and 10/764,995, all filed on Jan. 26, 2004.

BACKGROUND OF THE INVENTION

1. Field of the Invention

The present invention relates to an automated gaming platform, particularly an automated gaming platform that can support multiple players, automated gaming apparatus with a virtual dealt on a multi-player platform, and the implementation of baccarat games and methods on the platform with a side bet in the baccarat game.

2. Background of the Art

In the gaming industry, significant gambling occurs at live table games that use playing cards and a live dealer. Exemplary live table games include blackjack, poker, poker variants such as Let It Ride® stud poker, baccarat, casino war and other games. There are a number of proprietary or specialty live table card games which have developed, such as pai-gow poker, Let-It-Ride® stud poker, Three Card Poker® game, Four Card Poker® game, Caribbean Stud® poker and others. These and many other games all involve play using playing cards. The cards are dealt by a live dealer to the players, to a flop and/or to the dealer. The use of playing cards provided by a live dealer has a number of associated limitations and disadvantages that have long plagued the casino industry. Some of these are of general concern to all or most playing card games. Others are problems associated with the use of playing cards in particular games. Some of the principal concerns and problems are discussed below.

The use of playing cards at live table games typically involves several operational requirements that are time-consuming. These operations are conveniently described as collecting, shuffling, dealing and reading of the cards. In many card games there is also a step of cutting the deck after it has been shuffled. In the collecting operation, a live dealer typically collects the cards just played at the end of a hand of play. This is done in preparation for playing the next hand of cards. The cards must often be collected in the specific order in which they had appeared in the play of the game and must also be collected in a specific orientation, such as all cards being in a facedown or face-up condition. The cards also are typically straightened into a stack with the long sides and short sides aligned. These manipulations take time and are not typically appreciated by either the dealer or players as enhancing the play and entertainment value of the game. The use of physical cards also adds a regular cost to play of the game in the wear on decks of cards that must be replaced every few hours. In many games the cards collected at the end of the hand are deposited in a discard rack that collects the played cards until the time a new stack is obtained or the stack is shuffled. In some games the cards are immediately shuffled into the stack either manually or using a card shuffling machine. More typically, the cards are collected and then shuffling is performed later by the dealer or a shuffling device controlled by the dealer.

When shuffling is needed, it involves a break in the action of the table game and consumes a significant amount of time. Shuffling is also the most time consuming operation in preparing for the next hand. Thus, shuffling is of substantial financial significance to the casino industry because it requires significant time and reduces the number of hands that can be played per hour or other period of time. The earnings of casinos are primarily dependent upon the total number of hands played. This is true because the casino on average wins a certain percent of the amounts wagered, and many or most casinos are open on a 24-hour basis. Thus, earnings are limited by the number of hands that can be played per hour. In light of this there has been a significant and keen interest by casino owners to develop practices that allow more games to be played in a given amount of time. Accomplishing this without detracting from the players' enjoyment and desire to play the game is a challenging and longstanding issue with casino owners and consultants in the gaming industry. The use of high quality shuffling machines, such as those produced by Shuffle Master, Inc. (Las Vegas, Nev.) as shown in U.S. Pat. Nos. 6,655,684; 6,651,982; 6,588,751; 6,658,750; 6,568,678; 6,325,373; 6,254,096; 6,149,154; 6,139,014; 6,068,258; and 5,695,189 have significantly reduced the problem in down time, but there is still the need for a human operator and a human dealer in the use of these shuffling devices for casino table games.

The amount of time consumed by collecting, shuffling and dealing is also of significance in private card games because it also delays action and requires some special effort to perform. In private games there is also some added complexity due to card players remembering or figuring out which player had previously dealt and who should now shuffle and re-deal the cards as needed.

In addition to the time delay and added activity needed to collect, shuffle and deal cards, there is typically some time devoted to cutting the deck of cards which have been shuffled and which are soon to be dealt. This traditional maneuver helps to reduce the risk that the dealer who has shuffled the cards may have done so in a way that stacks the deck in an ordered fashion that may favor the dealer or someone else playing the game. Although cutting the deck does not require a large amount of time, it does take some time. The amount of time spent on cutting also somewhat reduces the frequency at which hands of the card game can be played and introduces another physical step in which human error or design can be introduced, such as dropping and exposing the cards or cutting the deck in a specific position to control the outcome in a fixed deck.

In the gaming industry there is also a very significant amount of time and effort devoted to security issues that relate to play of the casino games. Part of the security concerns stem from frequent attempts to cheat during play of the games. Attempts to cheat are made by players, dealers, or more significantly by dealers and players in collusion. This cheating seeks to affect the outcome of the game in a way that favors the dealer or players who are working together. The amount of cheating in card games is significant to the casino industry and constitutes a major security problem that has large associated losses. The costs of efforts to deter or prevent cheating are very large and made on a daily basis. Many of the attempts to cheat in the play of live table card games involve some aspect of dealer or player manipulation of cards during collection, shuffling, cutting or dealing of cards. Thus, there is a need for methods and apparatus that can be used in the play of live table card games that reduce the ability of the dealer and/or players to cheat by manipulation of playing cards. Of greatest concern are schemes whereby the deck is stacked and the stacked deck is used to the collusive player's advantage. Stacked decks represent huge potential losses since the player is aware of the cards which will be played before play occurs and can optimize winnings by increasing bets for winning hands and decreasing bets for losing hands. It is also desirable to provide decks or groups of cards where card counters are disadvantaged because of the reduction in their ability to track distributions of cards in the group of cards used for play. Continuous shufflers, in which cards are reintroduced into the group of cards being used, the introduction being random throughout the entire group, helps to eliminate that aspect of improper behavior at the gaming table.

Casinos have recognized that their efforts to reduce cheating would be improved if the casino had comprehensive information on the cards which have been played, the amounts bet, the players and dealers involved and other information about actions which have taken place at the card tables. This is of particular importance in assessing the use of stacked decks. It is also important where card tracking is occurring. Additional explanation about card tracking is discussed below. The information desired by the casinos includes knowing the sequence and exact cards being dealt. It would be even more advantageous to the casino if physical cards and live dealers could be eliminated, as this would remove almost all major existing methods of fraud from casino table card games.

Some attempts have been made to record card game action. The best current technology involves cameras that are mounted above the tables to record the action of the card games. This approach is disadvantaged by the fact that not all cards dealt are easily imaged from a camera position above the table because some or all of the cards are not dealt face-up, or are hidden by overlying cards. Although many blackjack games are sufficiently revealing to later determine the order of dealt cards, others are not. Other card games, such as poker, have hands that are not revealed. The covered cards of the players do not allow the order of dealt cards to be ascertained from an above-table camera or on table cameras, as exemplified by U.S. Pat. No. 6,313,871 (Schubert); U.S. Pat. No. 5,781,647 (Fishbine); and numerous patents assigned to MindPlay LLC (e.g., U.S. Pat. Nos. 6,663,490; 6,652,379; 6,638,161; 6,595,857; 6,579,181; 6,579,180; 6,533,662; 6,533,276; 6,530,837; 6,530,836; 6,527,271; 6,520,857; 6,517,436; 6,517,435; and 6,460,848.

Even where cameras are used, their use may not be effective. Such cameras may require time-consuming and tedious human analysis to go over the videotapes or other recordings of table action or require the use of software that is complex and imprecise. In some present systems, some human study may be needed just to ascertain the sequence of cards dealt or to determine the amount of betting or to confirm software determinations from camera read data. Such human analysis is costly and cannot economically be used to routinely monitor all action in a casino card room or table game pit.

For the above reasons, the video camera monitoring techniques have found very limited effectiveness as a routine approach for identifying cheating. There has also been relatively limited use as a serious analytical tool because of the difficulty of analysis. Such camera surveillance techniques are also of only limited effectiveness as a deterrent because many of the people involved with cheating have a working knowledge of their limitations and utilize approaches which are not easily detectible by such systems.

Another use of video camera monitoring and recording has been made in the context of analyzing card table action after someone has become a cheating or card counting suspect. The tape recordings serve as evidence to prove the cheating scheme. However, in the past, this has generally required other evidence to initially reveal the cheating so that careful analysis can be performed. More routine and general screening to detect cheating has remained a difficult and continuing problem for casinos. This is also a human intensive review, with both video monitoring security personnel and live personnel watching the players and apprehending players at the tables.

Another approach to reducing security problems utilizes card shoes having card detection capability. Card shoes hold a stack of cards containing typically from one to eight decks of cards. The cards are held in the card shoe in preparation for dealing and to secure the deck within a device that restricts access to the cards and helps prevent card manipulations. Card shoes can be fit with optical or magnetic sensors that detect the cards as they are being dealt. Some of the problems of security analysis using above-table cameras is reduced when the sequence of cards dealt can be directly determined at the card shoe using optical or magnetic sensors.

One advantage of such card shoes is that the card sequence information can be collected in a machine-readable format by sensing the specific nature (suit and rank) of each card as they are dealt out of the card shoe. However, most such card shoes have special requirements for the cards being used. Such cards must carry magnetic coding or are specifically adapted for optical reading. This increases the cost of the cards and may not fully resolve the problems and difficulties in obtaining accurate information concerning sequence information. The automated data collecting card shoes also do not have an inherent means for collecting data on the assignment of the card to a particular player or the dealer. They further do not collect data on the amounts bet. These factors thus require some other manual or partially automated data collection system to be used, or require that time-consuming human analysis be performed using video tapes as explained above.

The use in blackjack of numerous card decks, such as six decks, has been one strategy directed at minimizing the risk of card tracking or counting, especially when the set of cards is cut relatively shallowly so that many cards are not allowed into play from the set. Such tracking should be contrasted with card counting strategies which are typically less accurate and do not pose as substantial a risk of loss to the casino. Use of numerous card decks in a stack along with proper cut card placement can also reduce the risk of effective card counting. However, it has been found that multiple decks are not sufficient to overcome the skilled gambler's ability to track cards and turn the advantage against the house.

Card tracking can be thought of as being of two types. Sequential card tracking involves determination of the specific ordering of the card deck or decks being dealt. This can be determined or closely estimated for runs of cards, sequences of cards forming a portion or portions of a stack. Sequential card tracking can be devastating to a casino since a player taking advantage of such information can bet large in a winning situation and change the odds in favor of the player and against the casino.

Slug tracking involves determining runs of the deck or stack that show a higher frequency of certain important cards. For example, in the play of blackjack there are a relatively large number of 10-count cards. These 10-count cards are significant in producing winning blackjack hands or 20-count hands that are also frequently winning hands. Gamblers who are proficient in tracking slugs containing large numbers of 10-count cards can gain an advantage over the house and win in blackjack.

There is also a long-standing problem in the play of blackjack which concerns the situation when the dealer receives a blackjack hand in the initial two cards dealt. If the dealer has a 10-count card or ace as the up card, then it is possible for the dealer to have a blackjack. If the dealer does have a blackjack, then there is no reason to play the hand out since the outcome of the hand is already determined without further dealing. If the hand is fully played out, and the dealer then reveals that the dealer has received a blackjack hand, then a significant amount of time has been wasted. It also causes players to often be upset when a hand is played out to no avail. In many casinos the waste of time associated with playing out hands with a winning dealer blackjack has lead to various approaches that attempt to end the hand after the initial deal. Some of these allow the dealer to look at the down card to make a determination whether a blackjack hand has been dealt to the dealer. This looking is commonly called "peeking" and is an operation that has been the source of numerous cheating schemes involving dealers and players who work in collusion. In such cheating associated with peeking at the down card, the dealer cheats in collaboration with an accomplice-player. This cheating is frequently accomplished when the dealer signals the accomplice using eye movements, hand movements or other signals. If a dealer does not peek, then he does not know the value of his hand until after the players have completed their play. If the dealer does peek, then he can use such eye movements, hand movements or other techniques to convey instructions to his accomplice-player. These signals tell the accomplice what hand the dealer has been dealt. With this knowledge of the dealer's hand, the accomplice has improved odds of winning and this can be sufficient to turn the long-term odds in favor of the accomplice-player and against the casino. Many casinos do not allow the dealer to look at or inspect the down card until all insurance wagers have been made or declined.

There have also been a substantial number of apparatuses devised to facilitate the peeking procedure or render it less subject to abuse. Such peeking devices are intended to allow determination of whether the dealer has received a blackjack hand; however, this is done without revealing to the dealer what the down card is unless it makes a blackjack. Some of these devices require a special table with a peeking device installed in the table. Others allow the down card to be reviewed using a tabletop device in which the card is inserted. These systems and others involve the use of special playing cards. These devices and methods generally add greater costs and slow the play of the game. The slowed play often occurs to such a degree that it offsets the original purpose of saving the time associated with playing out possible dealer blackjack hands. The prior attempts have often ended up unacceptable and are removed.

Another notable problem suffered by live table games is the intimidation which many novice or less experienced players feel when playing such games. Surveys have indicated that many new or less experienced people who come to a casino are inclined to play slot machines and video card games. These people feel intimidation at a live table game because such games require quick thinking and decision making while other people are watching and waiting. This intimidation factor reduces participation in table games.

A further issue that has developed in the casino business is the public's increasing interest in participating in games that have a very large potential payoff. This may be in part a result of the large amount of publicity surrounding the state operated lotteries. News of huge payoffs is read with keen interest and creates expectations that gaming establishments should provide games with large jackpots. One approach has been the networked or progressive slot machines that use a centralized pool of funds contributed by numerous players. These slot machine systems are relatively more costly to purchase and operate. For many gamblers, this approach is not particularly attractive. This lack of attractiveness may be due to the impersonal and solitary nature of playing slot machines. It may alternatively be for other reasons. Whatever the reason, the public is clearly interested in participating in games that can offer potential jackpots that are very large. Table card games have not been able to satisfactorily address this interest. The continued diminishment in the percent of people who play live table games indicates the need for more attractive games and game systems that address to public's interests.

Further problems associated with live table card games are the costs associated with purchasing, handling and disposal of paper and plastic playing cards. Casinos pay relatively favorable prices for card decks, but the decks roughly cost about $1 per deck at this time. Each casino uses decks for a very limited period of time, typically only one shift, and almost always less than one day. After this relatively brief life in the limelight, the decks are disposed of in a suitable manner. In some cases they can be sold as souvenirs. This is done after the cards are specially marked or portions are punched out to show they have been decommissioned from a casino. This special marking allows the cards to be sold as souvenirs while reducing the risk that they will later be used at the card tables in a cheating scheme which involves slipping a winning card into play at an appropriate point. In other cases the playing cards are simply destroyed or recycled to eliminate this last risk. In any case, the cost of playing cards for a casino is significant and can easily run in the hundreds of thousands of dollars per year.

In addition to the above problems, there are also significant costs associated with handling and storing the new and worn playing cards. Sizable rooms located in the casino complexes are needed just to store the cards as they are coming and going. Thus, the high costs of casino facilities further exacerbate the costs associated with paper and plastic playing cards.

The most significant cost in operation of gaming apparatus is personnel costs. A number of attempts have been made to reduce time requirements for not only the dealers, relief dealers, but also for the supervisors, managers, security and the other staff that are directly or indirectly involved in the operation or maintenance of the games.

A number of attempts have been made to design and provide fully automated gaming machines that duplicate play of casino table card games. These attempts have ranged from and included the highly successful video poker slot games to the mildly successful slot-type blackjack game (for single players). In those systems, the individual player sits at an individual machine, inserts credits/currency/coins, and plays a one-on-one game that is controlled by a processor in the machine or to which the machine is distally connected (networked). These machines are common in casinos, but do not duplicate the ambience of the casino table game with multiple players present.

Another type of attempt for simulating casino table card games is the use of a bank of individual player positions associated with a single dealer position in an attempt to simulate the physical ambiance of a live casino table card game. Such systems are shown in U.S. Pat. No. 4,397,509 (Miller); U.S. Pat. No. 4,614,342 (Takashima); U.S. Pat. No. 4,995,615 (Cheng); U.S. Pat. No. 5,470,080 (Naku); and Published U.S. Patent Applications 2002/0169013 (Serizawa); 2003/0199316 (Miyamoto); and the like. These systems have a video display of a dealer and have individual monitors for display of the players' hands and the dealer hands. The architecture of these systems has generally been designed on a unique basis for each game, and there tends to be a main computer/processor that drives all elements of the game, or two computers/processors that distribute the video control of the dealer image and the remainder of the game elements between the two distinct computer/processors. This tends to maximize the cost of the system and tends to provide a slow system with high processing power demands to keep the operation working at speeds needed to maximize use and profit from the machines.

Sines, U.S. Pat. Nos. 6,651,985 and 6,270,404 describe an automated system for playing live casino table games having tabletop changeable playing card displays and play monitoring security features. Sines U.S. Pat. No. 6,165,069 describes an automated system for playing live casino table games having tabletop changeable playing card displays and monitoring security features.

The latter two patents (U.S. Pat. Nos. 6,270,404 and 6,165,069) are related as continuations and therefore have identical disclosures. U.S. Pat. No. 6,651,985 claims continuation-in-part status from the earliest application (U.S. Pat. No. 6,165,069).

Sines, U.S. Pat. No. 6,651,985, describes the use of a live dealer, even though virtual cards are used. There is no virtual dealer display and no software or architecture controls needed for a virtual dealer display. There are distinct display components for the players' hands and dealer's hand. Looking at FIGS. 23, 24 and 25 (which are identical to the same figures in U.S. Pat. No. 6,651,895, discussed above), it appears that at least for betting functions, the system operates with parallel communication to the player input stations. (See wire connections shown in FIGS. 24 and 25 to the Player Bet Interfaces 196, 198, 201 and 203.)

U.S. Pat. No. 6,607,443 (Miyamoto et al., Kabushiki Kaisha SEGA Enterprises) and Published U.S. Application 2003/0199316 A1 (also KKSE) and particularly FIGS. 1, 2, 3, 7, 9, 10, 11, 12 and 13, discloses a virtual blackjack table system. The main objective of this patent is to have optical data that enables the SEGA system to read hand signals of players, such as calls for hits and Stand signals. The hardware architecture in FIG. 15, as described in the specification at column 11, lines 29-54 show that there are distinct CPU's for the (audio and video, 280, 281, 282, 283) which is driven by the Sub-CPU, which is turn connected to the main CPU (201), with an additional sub-CPU 204 directing the motion sensor system 13, 14, 15, 16, and 32. There are distinct processing blocks for the sound (22), the video (21), the main CPU (20), and the subsystems (13), as well as the components already noted for the motion sensors/facial recognition sensors system.

U.S. Pat. No. 5,221,083 (Dote, SEGA Enterprises, Ltd.) describes a blackjack automated game system that has a reflected video image of a dealer and also has individual satellite player positions, with individual CRT monitors for each player. There is no disclosure of the type of information processing hardware in the system.

U.S. Pat. No. 5,934,998 (Forte and Sines, unassigned) and U.S. Pat. No. 5,586,766 (Forte and Sines, assigned to Casinovations, Inc.) describe systems using physical cards and a physical dealer, with no dealer display, on a blackjack table that has a CPU. FIGS. 6-10 show circuit construction and hardware considerations in the design of the system, including communication architecture. This system provides a count display (e.g., LED display) at each player position to show the player count and dealer count (as appropriate) that is determined from reading of the physical cards. Physical playing chips are also used; with no credit wagering capability is shown.

U.S. Pat. No. 5,159,549 describes a system that provides a multiple player game data processing unit with wager accounting. There are distinct player stations with player input on wagering. There may be a limited amount of intelligence at player stations (see column 4, line 1 through column 7, line 55), but there are multiple lines to each player station.

U.S. Pat. No. 4,614,342 (Takashima) describes an electronic game machine with distinct display units (CRT screens) at the player positions and the dealer position. The dealer screen (10) does not show an image of a dealer, but shows the dealer's card(s) and game information. There are typical player input controls (16) at each player position. The system provided is more like a bank of slot systems than a card table. In addition to a dealer data processor (6), each player position includes a player data processor CPU (30) with player memory (32). The central dealer computer apparently polls the individual player data processors to obtain the status of the events at each position (column 4, lines 1-60; and column 3, lines 8-17).

U.S. Pat. No. 5,586,936 (Bennett et al., assigned to Mikohn Gaming) teaches a ticketless control system for monitoring player activity at a table game, such as blackjack. Physical cards and physical chips are shown. Player identity cards identify each player entering play at a table, and a separate ticket printer issues a results ticket (500) at the end of play or reads the ticket at the beginning of play. There is no distinct intelligence apparent at each player position, and there is a central CPU that controls the system (e.g., FIG. 8). Physical chips and a real dealer are apparently used. A phone line (630) is connected from each player position to the CPU (820) through a communications port (814).

U.S. Pat. No. 4,995,615 (Cheng) describes a method and apparatus for performing fair card play. There are individual player positions with individual screens (12) provided for each player. There are three vertical, card-display screens (11, 13, 11) shown for "receiving instructions from the computer to display sequentially the cards being distributed throughout the processing of the play . . . " (Column 4, lines 4-13). There is no visual display of a dealer, there are individual player image panels, and no details of the architecture are shown or described.

U.S. Pat. Nos. 5,879,235; 5,976,019; and 6,394,898, assigned to SEGA Enterprises, Ltd. relate to non-card game systems, such as horse race simulators or ball game simulators (e.g., roulette). There is no dealer or croupier simulation. The horse race simulator is an automated miniature track with physically moving game elements. The point of interest is in evaluating the architecture to see how the intelligence is distributed between the player stations and the wagering screen. The system again shows individual monitors at each player position (80, 81) and no dealer display. The schematics of the electrical architecture in FIG. 11 shows a main board that also includes a Picture Control Section (95), Sound Control Section (96), and a communication control section (107). There is a distinct picture output board (108).

U.S. Pat. No. 6,607,443 (Miyamoto et al., Kabushiki Kaisha Sega Enterprises) shows an automated gaming table device in which there is an upright screen that displays a dealer's image. The particular purpose described in this patent is for recognition of sound and hand movement by players, but there is some description of the dealer screen display. For example, Column 7, line 45 through column 9, line 8 describes the images of the dealer provided on the main central screen 7 during game play. There is disclosure to the effect that a dealer's image and particular expressions and body position are provided (along with sound) of the dealer. There are no details at all with respect to the background, the combination of images or the like. U.S. Pat. No. 5,221,083 (Dote, Sega Enterprises, Ltd.) shows an automated gaming machine with a vertical image of a dealer presented to players sitting at a kiosk-type counsel. The screen or upright portion 2 has an image of a dealer 4 on a background or georama 13 that is formed on the inner surface of the upright portion 2. There are physical elements (e.g., pillars 14) that may be located in recesses in the upright portion 2 in front of the image to emphasize three-dimensionality. The table 5 is disposed in front of the pillars 14 and the image of the dealer 4 behind the pillars 14. The georama 13 is a physical image or construction, and the image of the dealer is originated in a CRT (e.g., 17) lying with the screen horizontal, and the image from the CRT 17 is reflected from a 45 degree mirror 20 for display to the players. This gives the illusion of the dealer being between the table and the georama background. The georama is a physical element, and has no video background at all. The dealer image is a reflected image, not a direct image. The reference appears to describe a distinct dealer image set against a backdrop of a scene.

It must be remembered that the technology of combining video images is standard commercial technology and is relatively old technology from the 1970's. Although many different backing colors may usefully be employed under special conditions, the most commonly selected backing color is substantially pure blue. Therefore, for clarity of description a blue backing will generally be assumed in the present discussion, and the process will ordinarily be referred to by the customary term, "blue screen process." However, any such simplifying assumptions and terminology, are not intended to imply that other colors may not be used, with corresponding modification of the procedure. For example, U.S. Pat. No. 3,595,987, entitled "Electronic Composite Photography" describes apparatus and operations that can be used in creating such combined video images.

U.S. Pat. No. 4,007,487 (Vlahos, Motion Picture Academy of America) describes an improved electronic compositing procedure and apparatus. The process is typically used in the blue screen process and it is suitable for processing motion pictures of professional quality and the like. The invention provides compensation for color impurity in the backing illumination over a continuous range of effective transparencies of the foreground scene. Applicant's previous method for limiting the blue video component for the foreground scene to permit reproduction of light blue foreground objects is improved by a dual limitation criterion which simultaneously suppresses blue flare light from the backing reflected by foreground objects of selected colors, typically including grey scale and flesh tones. The control signal for attenuating the background scene is developed as a difference function predominantly only at areas occupied by opaque or partially transparent foreground objects, and is developed predominantly as a ratio function at unobstructed backing areas, thereby compensating undesired variations in brightness of the backing illumination, while permitting desired shadows on the backing to be reproduced in the composite picture. This is an overlay imaging process for video imaging.

U.S. Pat. No. 4,100,569 (Vlahos) discloses an electronic circuit for combining foreground and background pictures substantially linearly, and included special arrangements for accommodating objects including both blue and magenta colors in the foreground. The system as described merges of foreground and background pictures through a wide range of transparency of the foreground objects. In addition to the normal type of transparent foreground images, including smoke, glasses, and the like, the edges of moving objects are shown as being partially transparent to provide the illusion of rapid movement.

U.S. Pat. No. 4,344,085 (Vlahos, Vlahos-Gottschalk Research) describes a blue screen imaging compositing process using a clean-up circuit that eliminates problems caused by footprints, dust, and dirt on the "blue-screen" floor or other single color backing for the foreground scene, by modifying the basic linear background control signal by using a dual control signal. The normal linear control signal operates over the entire picture in the normal manner. The second control signal is generated by amplifying the linear control signal and inserting it back into the control circuits via a linear OR gate. Thus, any selected level of the background control signal $E_c$ below 100 percent may be raised to 100 percent without influencing the lower levels of $E_c$. At a background control voltage level of perhaps 80 percent or 90 percent of the full background picture intensity, it may be abruptly increased to 100 percent. Above this selected level, any semi-transparency object, (for example the undesired footprint) is made fully transparent and is not reproduced. Further, while the foregoing signals are reduced to zero at this point, the background scene turn-on signal is raised to full intensity levels. This has the interesting collateral effect that thin wires that may be employed to support foreground objects may be rendered invisible, along with the undesired footprints and dust. There is no disclosure of its use for Video Gaming.

U.S. Pat. No. 6,661,425 describes a method for overlapping images in a display. An information input/output device has an intuitive operating feeling and improved information viewing and discriminating properties. The device comprises an superposing image extraction unit extracting a portion for super positional display from an image to output the extracted image portion as an superposing image, a mask pattern generating unit generating a mask pattern, effectors processing the superposing image, and the mask pattern based on the effect designation information, and a base image generating unit synthesizing the mask pattern image and the original image to generate a base image. The device also comprises a switcher, brightness/contrast controllers adjusting the brightness or contrast of the display image switching means, a control unit, super positional image display unit for superposed demonstration of display image planes of the displays and a display position adjustment mechanism. The display information of the image for display in superposition is demonstrated at a position that appears to be floated or recessed from the basic display plane.

U.S. Pat. No. 6,469,747 describes a video signal mixer with a parabolic signal mixing function, especially useful in scene-by-scene color correction systems and "blue screen" video masking applications. The mixer effects mixing two independent signal sources while smoothly controlling the rate of change during mixing. An input stage receives a first video signal and a second video signal. The mixing circuit mixes the first video signal with the second video signal based on a predetermined parabolic function. An aperture signal circuit in the mixer allows a degree of operator control over the parabolic function. An output stage provides a parabolized output signal. The output signal, which comprises the mixture of the first video signal and the second video signal, eliminates discontinuities in regions of the signal which would otherwise produce discontinuities in prior art types of video signal mixers. There is no specific description of the combining of live images on the screen with a preprogrammed image.

There are many wagering games used for gambling. Such games should be exciting to arouse players' interest and uncomplicated so they can be understood easily by a large number of players. Ideally, the games should include more than one wagering opportunity during the course of the game, yet be able to be played rapidly to a wager resolving outcome. Exciting play, the opportunity to make more than one wager and rapid wager resolution enhance players' interest and enjoyment because the frequency of betting opportunities and bet resolutions is increased.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by of a predetermined arrangement of cards in the player's hand. U.S. Pat. No. 4,836,553 (to Suttle and Jones) discloses a modified version of a five card stud poker game.

In addition to novel games being introduced into casinos, novel betting formats have also been introduced. Side bets have always been common in wagering environments, but the use of side bets for jackpots and bonuses in casino table card games was believed to have been first practiced by David Sklansky in about 1982 in a public showing of Sklansky's Poker in Las Vegas, Nev. The play and/or betting structure of Caribbean Stud Poker® was modeled after that game. Blackjack has allowed surrender play at many tables, where half the original wager is withdrawn and the other half is forfeited to the house at the election of the player. U.S. Pat. No. 5,820,460 (Fulton) describes a method for playing a casino table card game wherein wagers are changed after some cards are viewed by the player. Let It Ride® stud poker advanced that theory significantly as described in U.S. Pat. No. 6,273,424, where specific segments of wagers could be withdrawn from an original wager that was made in multiple parts.

In most casinos, a game of blackjack begins by having each player place an initial wager. The blackjack dealer then distributes two cards face-down to each player and two cards-one face up and another face down—to him or herself. After the player has examined the two dealt cards and compared those cards with the face-up dealer's card, a number of options present themselves to the player. The player may "stand" (i.e., take no further cards), draw one or more additional cards in order to increase the numeric sum of the hand, double down (a form of progressive wagering), or split the two cards.

Additionally, if the dealer's face-up card is an ace, the player may elect to buy insurance against the possibility that the dealer has a blackjack. If, after the dealer's face-down card is revealed, the dealer does not have a blackjack, the player loses the amount that was paid as insurance (although he or she may go on to ultimately win that deal). If, on the other hand, the dealer has a blackjack, the player collects double the amount of insurance bought (but may still lose the amount of the original wager). The option of purchasing insurance is unique to blackjack type games and has not, heretofore, been available in poker-style games. The broad rules of blackjack are generally known to those skilled in the art and a fuller description may be found in the materials previously incorporated by reference.

In an attempt to accommodate the desire for variety and the retention of a significant table game presence, several Blackjack variant games and baccarat variant games have been introduced. These games include Mini-Baccarat, progressive win side bets in Baccarat, Multiple Action Blackjack, Spanish 21, Over and Under 13, Face-Up 21, and Royal Match. See, e.g., U.S. Pat. No. 5,673,917 to Vancura. A summary of known Blackjack variants is discussed in the Vancura patent.

The addition of side bet wagers to table games has provided an additional level of excitement and a chance for increased awards to be made in table games. The side bet in Over and Under 13 is limited to a one-to-one payout, so again, large payouts are provided with only large wagers. Such games as Minnesota 21™ provide higher bonuses (e.g., as much as $500 on a one dollar side bet for three consecutive blackjacks) with a side bet or house take based on the level of the underlying wagers. Other payouts that are multiples of the house take are based on hands of 6-7-8, blackjacks in suit, and the like.

U.S. Pat. No. 6,296,251 describes a baccarat or blackjack game with a payout that is a multiple of the initial wager (there is no side bet or additional wager beyond the wager on the underlying game). The broadest concept of the game described is as a method of playing a casino card game that is based on card hand numerical totals (e.g., blackjack and baccarat) and includes a player core wager, the core wager being the only wager required for the player to participate in the game. The method comprises establishing a dealer hand having a numerical total and a player hand having a numerical total; and paying a variable payoff according to the player core wager that varies according to an amount of numerical difference between the dealer hand numerical total and the player hand numerical total. A typical pay table for blackjack is described as

| Player Wins By | Payoff |
|---|---|
| 4 | 4 to 1 |
| 3 | 3 to 1 |
| 2 | 2 to 1 |
| 1 | 1 to 1 |

It is desirable to design and provide additional games, especially baccarat games, that provide good profits for the house and more betting opportunities, while providing players with more exciting play, more variety in play, and an opportunity to obtain greater payouts, especially payouts in excess of 5:1.

In addition to novel games being introduced into casinos, novel betting formats have also been introduced. Side bets have always been common in wagering environments, but the use of side bets for jackpots and bonuses in casino table card games was believed to have been first practiced by David Sklansky in about 1982 in a public showing of Sklansky's Poker in Las Vegas, Nev. The play and/or betting structure of Caribbean Stud Poker® was modeled after that game. Blackjack has allowed surrender play at many tables, where half the original wager is withdrawn and the other half is forfeited to the house at the election of the player. U.S. Pat. No. 5,820,460 (Fulton) describes a method for playing a casino table card game wherein wagers are changed after some cards are viewed by the player. Let It Rideg stud poker advanced that theory significantly as described in U.S. Pat. No. 6,273,424, where specific segments of wagers could be withdrawn from an original wager that was made in multiple parts.

All of this background art is incorporated herein by reference in its entirety to provide technical knowledge on how images can be combined and integrated for display in the gaming device imaging system described in the practice of the present invention.

SUMMARY OF THE INVENTION

A multi-player automated casino table card game platform enables play of casino table poker-type games according to rules effected through a processor. It is thus an aspect of the invention to provide a method and apparatus for playing a baccarat-type card game that overcomes some of the limitations associated with conventional casino baccarat games such as repetitiveness, lack of multiple odds, and the like. It is another aspect of the invention to provide a baccarat-type card game incorporating a variable payoff based on a side wager as to either a natural count of 8 or 9 being obtained on the first two cards or the magnitude of the difference between a player's hand point count and a banker's hand point count. The player may place a side bet on the player's hand or the banker's hand. The hand that was bet on must be higher in rank than the hand that was not bet on by the player in order for the player to qualify to receive a payout on the side bet.

According to the invention, a casino game is provided that can be played on existing baccarat tables with minor side bet placement identification markings on the layout and different printed rules. The game according to the invention is a Baccarat derivative or Mini-Baccarat derivative, wherein there are two potential payouts in addition to normal play of the game. One payoff for wagering on a winning hand (either the player's hand or a banker's hand) is based upon the hand that is wagered upon having a natural (two-card) 8-count or 9-count. A second payout is based upon the size of the difference between player hand point count and banker hand point counts, with the hand that the player has bet on being higher in rank than the other hand. For example, the player could win the side bet by placing a bet on the dealer hand, and the dealer hand beating the "player" hand by a predetermined minimum point difference.

DETAILED DESCRIPTION OF THE INVENTION

Figure 1:
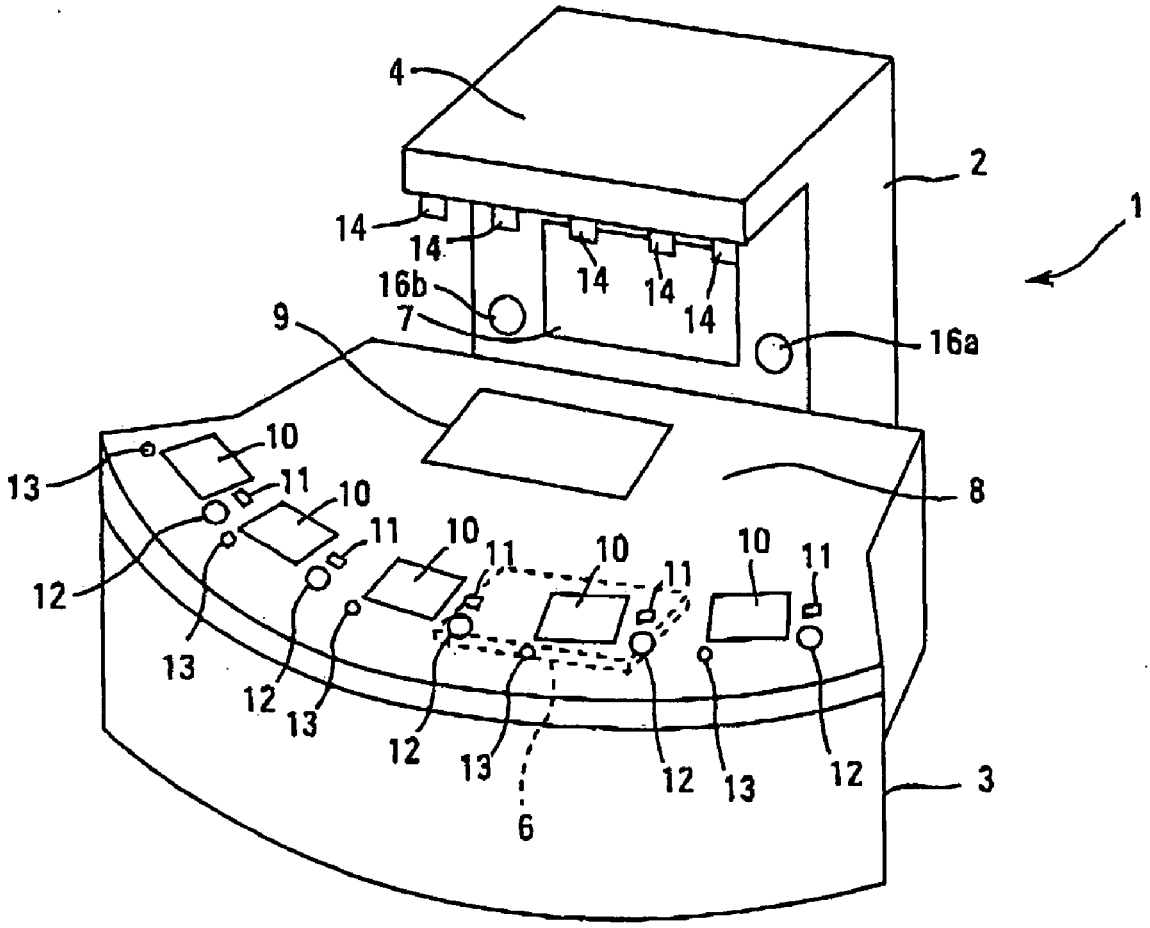
Fig. 1 Prior Art
FIG. 1 shows a perspective view of a prior art format for an automated gaming system.

The games of the present invention may be implemented as live table games, television or cable game show games, video poker gaming machine platforms, hand-held games for play, multiple player interactive wagering platform games (with kiosk formats, single player screens, community screens, and/or banks of seats for players with a common dealer screen), cell phone games, games downloadable from the internet, parlor games, games executed on personal computers, hand-held personal games, palm pilots, play stations and the like. Each of the above game applications is contemplated by the present invention.

There are a number of variations of the basic game of baccarat, and the game is sometimes referred to in its various forms as Baccarat-Chemin-de-Fer, Baccarat a deux tableaux, Mini-Baccarat, and the like. The rules may vary slightly, and rules may vary from casino to casino, but the underlying game is the same. The underlying game is a competition between the hands of two players, usually referred to as the banker and the player. House-banked games such as those games played in Las Vegas-style casinos have a dealer's hand, rather than a banker's hand. However, the terms "dealer" and "banker" are interchangeable terms for purposes of this disclosure. All players at the table can place wagers, but only one player participates in the game by receiving a hand of cards. Initially, two cards are dealt to each of a single designated player and the designated banker. Each initial or partial two-card hand is reviewed by the banker and the player. The results of the competition are determined by how close the point total (explained in detail later) is to a value of nine. Two card hands with a point total of 8 or 9 are naturals. Point totals are based on the added face value of the cards, with the values of the cards being Ace=1, 2=2, 3=3, 4=4, 5=5, 6=6, 7=7, 8=8, 9=9, 10=0, Jack=0, Queen=0, and King=0. Only the last digit of the sum of the point values of the cards is operative in the play of the game. For example, a total value of the cards (both with the original hand or partial hand) would be read as 10=0, 11=1, 12=2, 13=3, 14=4, 15=5, 16=6, 17=7, 18=8, 19-9, 20=0, etc. A player is usually given the option on playing (wagering on) either the player's hand or the banker's hand. This is accomplished by placing the wager in a designated space for a wager on the banker's hand or the player's hand. A commission is usually extracted from the winning bets on the banker's hand (e.g., 5% of the winning bet on the banker's hand), because the banker usually wins more often than the player. No commissions are paid to the house when the player bets on the player hand.

There may also be a separate wager placed on the occurrence that the banker's hand and the player's hand will tie. Depending on the odds provided by the house (usually from 8:1, 9:1 or 10:1), the house advantage is between 4.5% and 15%.

In accordance with yet another aspect of the invention, there is provided an apparatus configured for playing a card game having a display, a player interface, and a controller receiving input from the player interface, the controller including circuitry for effecting game play and including structure for receiving a base game wager from a player and the optional BIG WIN BONUS wager and for dealing hands of cards to a player and a dealer, and a processing circuit operatively coupled with the receiving and dealing structure. The processing circuit determines an outcome of the base card game and if necessary, separately calculates separate numerical values of the base game hands to score the bonus wager. In one preferred form of the invention, the numerical hand values are used to determine the outcome in the base game. If the player wins the card game according to the rules of the base card game or based on the BIG WIN BONUS wager, the player is paid a payoff based on the base game wager and then a bonus payout determined by a numerical difference (or point spread) between the player's hand and the banker's hand.

According to still another aspect of the invention, there is provided an apparatus for playing a casino card game that is based on card hand numerical totals and includes a player base game wager and the BIG WIN BONUS wager. In one example of the invention, both bets are optional. In other forms of the invention, both bets are mandatory, the bonus bet is mandatory or just the base game bet is mandatory. The apparatus includes a display, a player interface, and a controller receiving input from the player interface. The controller includes circuitry for effecting game play and structure for paying a variable payoff according to the player base game wager and the bonus game wager based on a difference between a dealer hand numerical total and a player hand numerical total.

In the following detailed description, the method and apparatus according to the present invention will be described in conjunction with its application to a casino environment, thus incorporating wagers, payouts, etc. Those of ordinary skill in the art will readily comprehend alternative applications of the present invention outside a casino environment, and the invention is not meant to be limited to the described application. For example, the game may be embodied in a video game that is played for entertainment purposes against a computer or the like. Alternatively, players may play the game without wagers in a head-to-head format with one player acting as a dealer, with the players simply keeping track of wins and losses.

As with conventional Baccarat, the number of card decks used for the game according to the invention may be one or more. Typically eight decks are used in the play of baccarat. Each player places a base game baccarat wager in a respective betting area in order to participate in the game. In the context of the present invention, the base wager may be the only wager, or the game may be played with the base game wager mandatory and the BIG WIN BONUS wager optional, both bets are required, or the BIG WIN BONUS is the only wager required for a player to participate in the game. It is possible for the game to be played with a wager on only the BIG WIN Bonus wager and with no underlying wager being placed on the baccarat-type game, but it is preferred that the underlying wager on the baccarat game must be placed to enter in the BIG WIN BONUS game.

After wagers are placed, the designated player receives two cards in rotation (one card at a time) or in sequence (two cards at a time) with the banker receiving two cards face down. The player then elects how to play the player hand according to the game rules, which may be printed on the table top (not shown). After all player actions are completed, the banker's hand is played according to the game rules, and all wagers are settled according to the payoff scales. In preferred forms, if the player wins the card game according to the rules, the player is paid a payoff based on the base game wager and then the BIG WIN BONUS wager/payout is determined by a numerical difference between the player's hand and the dealer's hand, depending upon which hand is wagered upon. For example, the player might receive a 1:1 payout for playing the banker hand, when the banker hand is a 6 and the player hand is a 4. The player would not receive a payout on the bonus hand because the minimum point spread to obtain a payout when the bet upon hand is not a natural is 5. Since the player did not obtain a natural or beat the opposing hand by 5 points or more, no bonus payout is awarded.

Thus according to the present invention, there is a fixed bonus payoff for a natural in addition to any payoff on the underlying game wager and a variable payoff paid according to the player's side bet wager based on a difference between the hand numerical total bet on by the player to participate in the bonus game and the numerical total of the opposing hand. As the player may make the bonus bet on either the player or banker hand, the bonus point spreads are evaluated on the basis of a) point totals, and b) whether the player bet on the higher ranking hand. As noted above, this methodology effects greater enjoyment for players with the possibility of higher payoffs than in conventional Baccarat and also enables novice and inexperienced players to play the underlying game with fixed rules.

Figure 9:
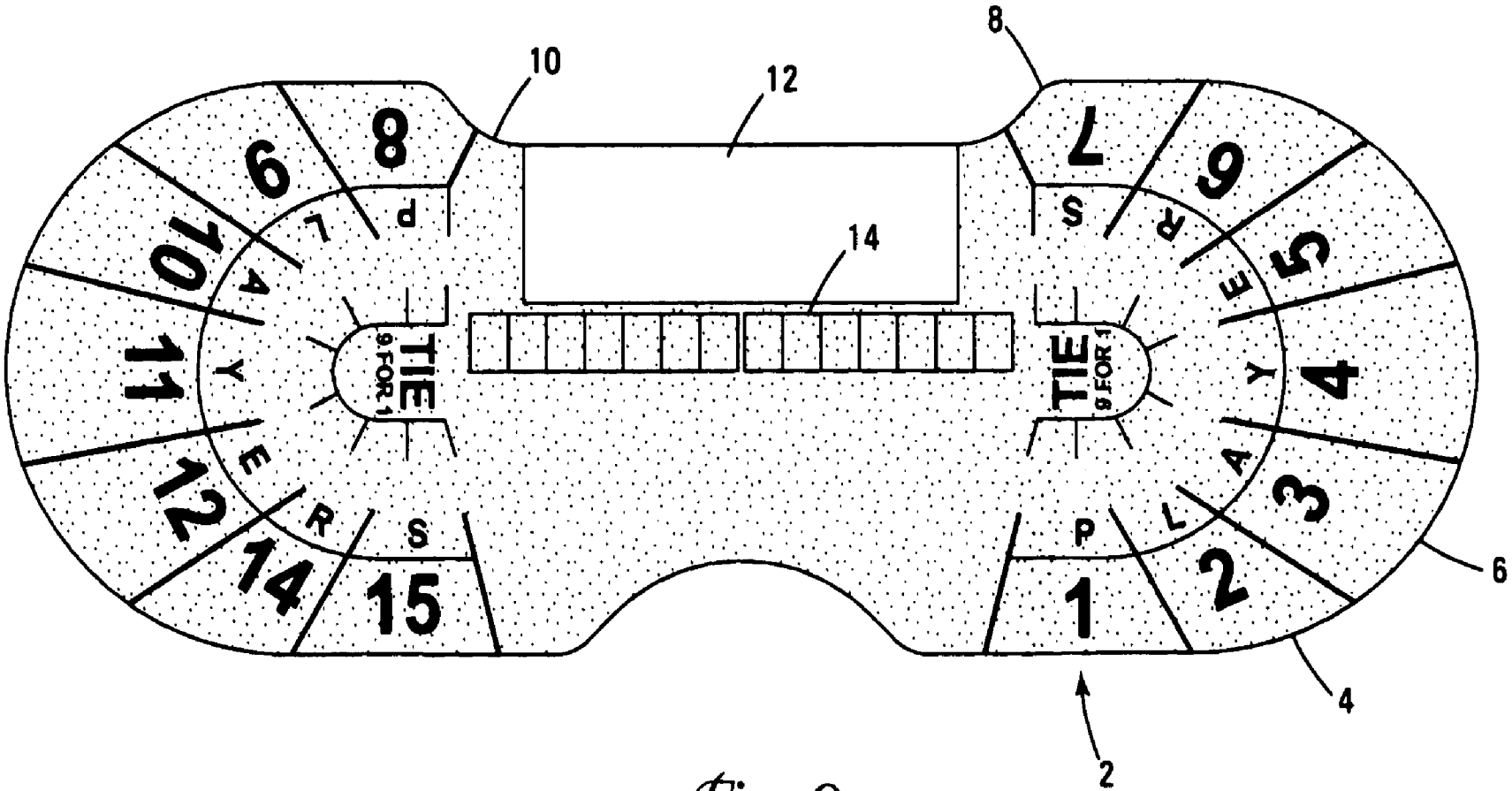
FIG. 9 shows a basic table format for a standard baccarat-type game.

A typical standard baccarat-type wagering game table 2 is shown in FIG. 9. The game table 2 has 15 player positions 4 numbered 1-15. There is a distinct area 6 labeled P-L-A-Y-E-R-S for placement at each player location for placement of the wager on the Player's hand. Adjacent to the Player's wager area 6 is an area 8 labeled as B-A-N-K-E-R-S for placement of the individual Player's wagers on the Banker's hand. Each player may place a bet or bets, even if that player is not designated to receive the player cards. Further interior on the table 2 is a series of spaces 8 numbered 1, 2, 3, 4, 5, 6, 7 and spaces 10 numbered 8, 9, 10, 11, 12, 13, 14 and 15 (one space for each Player again) for placement of the tie wager.

Play is usually begun by having the dealer shoe (of multiple decks of shuffled cards) passed to a player (e.g., beginning with the player in seat number 1). The player in the dealing position must make at least a wager of the minimum table requirement. The bet must be directed to the player's hand or the banker's hand. Since the banker's hand has a higher likelihood of winning, the first player will usually wager on the banker's hand. The shoe is passed to the next player when the first dealer loses a hand or relinquishes the deal.

In traditional baccarat, only two hands are dealt in play. One hand is referred to as the banker's hand and the other hand is referred to as the player's hand. The first and third cards are dealt to the caller (a casino operator who calls the cards) and the second and fourth cards are dealt to the banker. All cards are dealt face down. The caller may slide the Banker's cards to a player (usually the player with the highest wager), although security concerns have limited this courtesy in card play. Both the player's hand and the banker's hand are then passed to the caller. He positions the hands in the appropriate positions and views the hands. If one hand is a natural (an original two card point count of 8 or 9) and the other hand is not, the hand that is a natural is a winning hand and the bets are paid off at odds of 1:1. A standard set of rules of play for the game with regard to play of the hand is:

| Player's 2-Card Hand | Action |
|---|---|
| 0 to 5 | Player may draw 1 card |
| 6 or higher | Player must stand |

When the player stands (does not draw), the rules for the banker are:

| Banker's 2-Card Hand | Action |
|---|---|
| 0 to 5 | Banker must draw 1 card |
| 6 or higher | Banker must stand |

When the player draws, the rules of play for the banker's hand are traditionally:

| Banker's 2-Card Hand | Action |
|---|---|
| 0 to 2 | Banker must draw 1 card |
| 3 or higher | Banker must stand |

It is to be noted that these are general and common rules that may be used for play of baccarat. The rules are subject to local variation and may be more variable based upon the odds that are provided in the play of the BIG WIN BONUS side bet game of the present invention.

In the FIG. 9, the placement position 14 for placement of wager payouts for the player's that is positioned in front of the caller's position 12 may also be used for placement of the BIG WIN BONUS wager. The players may pass the wager to the caller/dealer, and the wagers on the bonus game placed before the deal of the game. Two additional rows of such betting positions (not shown) may be provided, one for making the BIG WIN BONUS wager on the banker's hand and the other for placement of the BIG WIN BONUS wager on the player's hand. Although it is more typical for the player to bet on the dealer or player hand for both the primary base game bet and the bonus bet, according to one example of the game, the player may place the primary bet on either hand, and may place the bonus bet on either hand. For example, the player may choose to play the banker's hand on the base game and the player's hand on the bonus game. Before the beginning of play, both the player's underlying game wager is made on the player's hand wager positions 4 and the banker's hand positions 6, and in the player of BIG WIN BONUS, when all players have been given the option to place the bonus wager.

Figure 10:
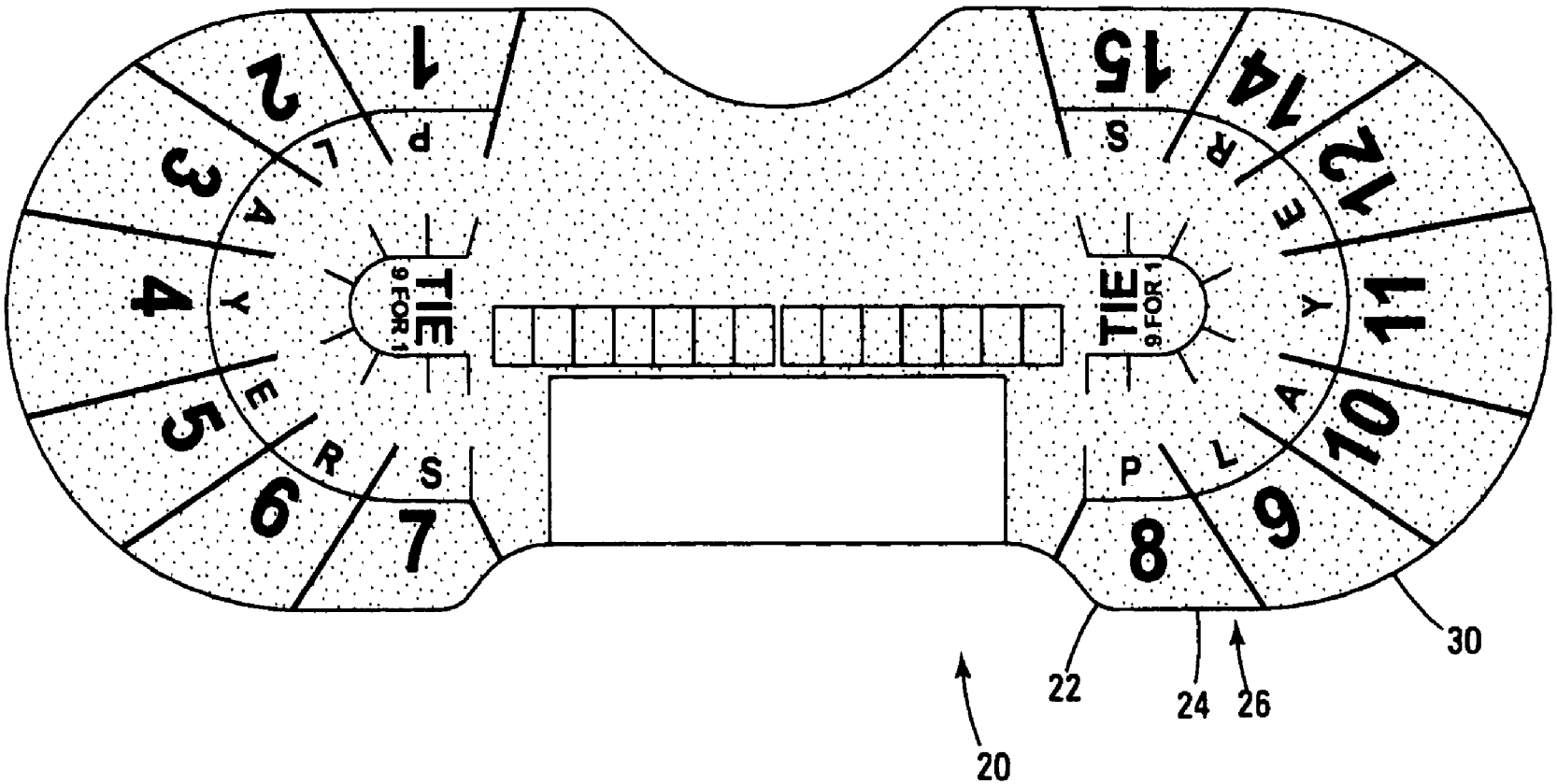
FIG. 10 shows a top plan view of a mini baccarat-type game with BIG BONUS WIN wagering side bet played on a multiple player platform.

In FIG. 10, each player position 26 on the table 20 is provided with two distinct wagering areas 22 and 24. These wagering positions may represent separate wagering areas 22 and 24 that may be bet placement area that are marked, for example, by printing on the table 20 top 30 to mark area 22 as a banker's hand BIG WIN BONUS wager and area 24 as a player's hand BIG WIN BONUS wager. Alternatively, two bet accepting structures (e.g., proximity detectors, slots, sensors, etc.) may be provided at each player's position 24 on the table 20 top 30 to provide area 22 as a banker's hand BIG WIN BONUS wager and area 24 as a player's hand BIG WIN BONUS wager.

Although the side bet game of the present invention can be played in conjunction with traditional baccarat, in another example of the invention, the side bet is offered with the game of mini baccarat. The rules of mini baccarat are essentially the same, except the dealer handles all of the cards. Each player is free to bet on the player hand or the dealer hand, as in traditional baccarat. If the player makes a side bet, the hand upon which the side bet is placed must rank higher than the other hand in order to qualify for a payout in the bonus game. Although the hitting schedule may not be identical to that of traditional baccarat, the basic game is essentially the same, with the object of the game being to bet on the hand that achieves a point value closest to 9. In order to win the side bet, the player must have made the side bet wager on a hand that is either a natural (a two card 8 or 9) or beats the competing hand by a minimum predetermined point spread, such as 5, 6 or 7 points (5 is preferred), for example.

The basic baccarat-type game including the BIG WIN BONUS event may be generally described as a method of playing a wagering baccarat-type card game comprising both an underlying (preferably a baccarat-type) card game and an auxiliary card game. The play of the game generally comprises placing at least one first wager on the underlying card game. In alternate embodiments, the house rules may allow the player to participate in either the base game, the auxiliary game or both the base game and the auxiliary game. The first wager may be placed on a player's hand or on a banker's hand. In one preferred form of the invention, the player has an option of placing a second, side bet wager on the auxiliary card game. This second, side bet wager may be independently placed on the player hand or the banker hand. According to the invention, the player has the option to: a) place both bets on the player hand; b) place both bets on the banker hand; c) place a base bet on the banker hand and the auxiliary bet on the player hand; or d) place a base bet on the player hand and the auxiliary bet on the banker hand. In a preferred form of play, after placement of at least the first wager (and after any optional, second wager) the player is dealt a first number of cards (preferably one or usually two cards). At about the same time, the banker (sometimes referred to as a dealer) is usually dealt the same number of cards as was dealt to the player. The initial hand of cards need not be limited to two cards, but this is a preferred form of play. The base game also need not be limited to a game in which the point value of each card is summed in the base game. For example, the underlying game could be a three card poker game against a dealer hand, in which the point total of the hand in only the auxiliary game is summed to determine whether a bonus payout has been won. The rules of the game may or may not allow the player to draw additional cards. For example, if the base game is three card poker, each player and dealer each receive three cards. The base game is resolved using a known hierarchy of three card poker rankings, and then the point values of those assigned in baccarat or blackjack are used to determine whether the player has won the side bet. Necessarily the selected minimum winning point spread may be different than the five point minimum preferred in the game of baccarat. According to this form of the game, the player still has an option of playing either the player or dealer base game hand, and playing (or not playing) the optional side bet on either the player or dealer hand.

After the player views that player's cards, the player evaluates a point count in the player's hand. If the player has wagered on the player's hand and there is a natural (a count of 8 or 9 with the first two cards), the player will have won part of the bonus event. The player continues the game by a) accepting a card or b) declining a card and staying with the original point count. If house rules dictate when the player must take a hit, the player must abide by those rules. The banker's cards are then exposed, the banker takes or declines cards based upon the rules of the game. As noted above, these rules may vary among casinos and may vary according to the play of the bonus game of the invention. Resolution of the first wager is made. If the player has wagered on the player hand, the player wins if the point count of the player's hand exceeds the point count of the banker's hand, with a maximum point count of 9 being possible according to the rules of the game. Typically the house pays 3:2 on a 8 or 9 point natural, and 1:1 when the player has bet on the hand that beats the other hand in point count. After resolution or at least determination of the results of the first wager, the player's hand and the banker's hand are compared to determine if the player has qualified to win a bonus payout amount. Resolution of the bonus wager according to the rules of the bonus event may be selected from the group consisting of:

a) when the wager was made on the banker's hand or the player's hand (designating that hand as the 'wagered hand');
b) providing and award on the side bet wager when the wagered hand is a natural (when a 2 card hand has a point total of 8 or 9); and
c) providing an award on the side bet wager when the wagered hand exceeds the other hand by a minimum of 5 points.

The rules of the game may provide for paying an award for b or c in the alternative, or both b and c with the same hand. For example, if the player has a 9 point natural, and has placed both the basic bet and the side bet on the player hand, and the banker has a point count of 3, the house rules may provide a payout for the base game of 1:1, plus a payout on the bonus bet for the natural, the 6 point spread or both. Although in the play of conventional baccarat, only one player hand is dealt, in mini baccarat, all players receive a separate hand of cards in each round of play. The side bet method of the present invention is also suitable for playing in conjunction with the game of mini baccarat. The introduction of a variable payoff scale would have a dramatic impact on best basic player strategy if there were not conventional rules applied to the play of the game with regard to required hits or required stands. The optional hits may be converted to required hits in the rules described above to assure that play in the underlying game is not affected by the additional wager. This would prevent one player at the table controlling hits that would be favorable to that player's wager, yet would be antagonistic to the strategy for the wager of another player. As the player only receives 1:1 payout on the underlying game, and basic strategy usually holds that a player should stay with a count of 5 or 6, there is an incentive for the player to hit hands to increase the possible difference between the winning hand wagered upon (the player's hand or banker's hand) and the other hand (the banker's hand or the player's hand, respectively). This contrasts with the ordinary play of baccarat where standing or hitting such hands is influenced by reference to the card counting or staying with "the book" bet of hitting with hands below 5 or 6 and staying with hands of at least 5 or 6. Moreover, because of the variable payoff scale, a higher or lower player hand has more value, compounding the attraction of not standing on 5 or 6, or if the banker's hand has been wagered on, taking a hit when the player's hand has a good point count.

By creating a payoff scale that justifies a somewhat similar strategy of play to conventional baccarat, the game according to the present invention is simple to learn. The rule is that it is the player's goal to achieve a total single digit point count that is higher than the banker's hand single digit point count. If the player has bet on the higher ranking hand, he or she is typically paid 1:1 on the base game bet.

The addition of an odds-based payoff scale to essentially an even money game therefore changes the whole dynamics of the game. Other casino games that rely on numerical values such as War can easily be adapted according to the invention with the introduction of the payoff scale, with payoffs depending upon the amount by which a hand is won. As with Baccarat, the exact rules of play for the game variant should or could be changed to most easily accommodate the payoff scale introduction.

Similarly, the bonus game could be scored using numerical values, while the base game is scored utilizing other scoring rules, such as the rules of poker.

These and other objects and advantages of the invention are achieved by providing a method of playing a card game including the steps of (a) receiving a core base wager from a player; (b) dealing hands of cards to a player and a dealer; (c) determining an outcome of the card game according to rules of the card game; (d) determining the point value of the player and dealer hands in the base game and (e) whether or not the player wins the card game according to the rules of the base card game, paying the player a payoff based on the BIG WIN BONUS wager determined by a numerical difference between the player's hand and the banker's hand.

Step (b) may be practiced by dealing initial or partial two-card Baccarat hands of cards to the player and the dealer, and step (c) may be practiced according to the rules of Baccarat or Mini-Baccarat. In this context, step (c) is preferably practiced by (c1) the player determining a numerical total of the player's hand; (c2) the player effecting one or more game options according to the rules of Baccarat (c3) the dealer determining a numerical total of the dealer's hand. Still further, the payout on the underlying baccarat game may be practiced by declaring the wager a push if the player hand numerical total is equal to the dealer hand numerical total. In the event of a push, the difference between the player's hand count and the dealer's hand count would always be below the minimum difference for the BIG WIN BONUS, although a wager on that bonus may still be paid based on the occurrence of a natural hand. The house would pay the player a variable payoff based on the BIG WIN BONUS wager according to the numerical difference between the player's hand and the dealer's hand if the player hand numerical total exceeds the banker hand numerical total or the banker hand numerical total exceeds the player hand numerical total by the minimum amount. The player forfeits the BIG WIN BONUS wager if the dealer hand numerical total exceeds the player hand numerical total. In one form of the invention, if the hand the player placed the bonus wager on is a natural, the player is paid for achieving that outcome, but not paid additionally for obtaining a point spread below the minimum. In another form of the invention, it is possible for the player to win a bonus payout for obtaining a natural and an additional bonus payout for achieving a high ranking hand with a point spread at or above stated minimum.

In one example of the invention, the variable payoff is determined according to the following schedule:

| Outcome | Player | Banker |
|---|---|---|
| Win by 9 Points | 30:1 | 30:1 |
| Win by 8 Points | 10:1 | 15:1 |
| Win by 7 Points | 9:1 | 9:1 |
| Win by 6 Points | 4:1 | 6:1 |
| Win by 5 Points | 1:1 | 1:1 |
| Natural Winner | 1:1 | 1:1 |

In another example of the invention, the pay table is the same for the player hand and the banker hand. An exemplary pay table for one preferred embodiment is shown below:

| Outcome | Player or Banker |
|---|---|
| Win by 9 Points | 30:1 |
| Win by 8 Points | 10:1 |
| Win by 7 Points | 8:1 |
| Win by 6 Points | 5:1 |
| Win by 5 Points | 3:1 |
| Natural Winner | 1:1 |

The hit frequency is expected to be approximately 25.3% on the player hand and 24.3% on the Banker hand using the above pay table. The house edge is approximately 2.2% on the player hand and about 10.5% on the banker hand.

In one example, if the player were to bet on the player hand and received a 9 point natural, and the dealer hand was 3 points, the player wins 1:1 on the bonus bet and another 5:1 on the point spread. In another example of the invention, only the highest payout pays, and the player would win 5:1 only on the bonus bet.

The range of bonus payouts may be preferably within the range of:

| Outcome | Player | Banker |
|---|---|---|
| Win by 9 Points | 15:1-40:1 | 15:1-40:1 |
| Win by 8 Points | 6:1-15:1 | 6:1-18:1 |
| Win by 7 Points | 5:1-10:1 | 5:1-9:1 |
| Win by 6 Points | 2:1-5:1 | 2:1-7:1 |
| Win by 5 Points | 1:1-3:1 | 1:1-3:1 |
| Natural Winner | 1:1-2:1 | 1:1-2:1 |

In alternative variations, the base game may be practiced according to the rules of War, blackjack, three card poker, five card poker, seven card poker or other known casino game. In those instances, the specific point spread and associated payout odds would necessarily vary, and would be determined by the game mathematics. For example, for purposes of evaluating the bonus game, all face cards and ten cards in the hand could be assigned a value of zero or 10, regardless of the rules of the underlying game.

In accordance with another aspect of the invention, there is provided a method of playing a casino card game that is capable of being evaluated on card hand numerical totals for the purpose of scoring the auxiliary game and includes a player base game wager and the bonus game wager. The method includes paying a variable payoff according to the player bonus wager based on a difference between a dealer hand numerical total and a player hand numerical total. The base game may pay odds, or may pay variable odds, depending upon the rules of the game. The variable payoff is preferably determined according to a predetermined payout schedule.

Although in a preferred method of the invention the player receives a bonus only when the hand that he or she wagered on is higher in point value than the opposing hand, the house rules could provide that the player be paid a payout for absolute point spreads between the player and banker (or dealer) hands, regardless of the selection of hands. In other words, the player could place a side bet on the occurrence of a point spread of five or more points, regardless of which hand is higher. This rule variation would necessarily require a modification of (a lowering of at least some) payout odds for the various point spread combinations, as the combinations would occur more frequently under this set of game rules.

Still another aspect of the present invention is to provide a wagering game that is easy to learn, yet demands skill of players in making strategic decisions about whether to withdraw a portion of the bet. It is yet another aspect of the present invention to provide a unique, exciting card game for play in casinos or at home and on various media including casino tables, video poker machines, video lottery terminals or home computers. It is an advantage of the game of the present invention that wagering decisions are inherent in the game. The game enhances players' sense of participation and takes advantage of players' inclination to keep wagers at risk once placed. The interdependency of at least two bets further encourages players to let bets remain at risk.

Apparatus is disclosed for playing the wagering game according to the method outlined above. A typical gaming table, with a playing surface, is modified to include specific areas that provide locations for placing the wagers and for displaying the common cards. A card shuffling machine such as that disclosed in U.S. Pat. No. 4,807,884 or other shuffling machines manufactured by Shuffle Master Gaming, Inc. of Las Vegas, Nev. for facilitating and speeding the play of the wagering game may be used. A display device may be associated with the apparatus for displaying game information, shuffle status, or other information relevant to the dealer, the players or the house.

A gaming system that can be used to practice the method of the present invention comprises a table and a dealer "virtual" video display system positioned for view by players seated at the table. The table may seat at least two players up to the amount of players that can be configured about the table and have a view of the dealer video display system. Typically each gaming system will have at least four player available positions, with space determinations considered as to whether there would be 4, 5, 6 or 7 player positions. It is possible to have a completely circular dealer display (e.g., holographic display in a cylindrical centerpiece) and have players distributed around the entire periphery, but this is too dissimilar to standard play arrangements and could slow the game down, as play should approximate that of a live game, with players sitting together playing in sequence. A surface of the table will include a generally continuous display screen on the surface for showing all player hands, community cards, dealer hands and any other cards used to play the game for any purpose. Touch screen player controls or conventional push button controls may also be provided. A majority of the table surface comprises a video monitor in one example of the invention. Where there are no touch screen controls, the table surface may include player control panels at each player station near the continuous display screen. The use of a continuous display screen offers some significant advantages in simulating or recreating a standard card table surface. Cards may be readily viewed by other players at a table, which is standard in table games and adds to player enjoyment. Individual monitors, especially where slanted towards the individual players make such table-wide card reading difficult. The use of the full screen (continuous) display also allows for better animation to be provided, such as displaying virtual images of cards moving to the player and "virtual" chips being placed on the table when wagers are indicated. For purposes of this disclosure, the term "virtual" means a graphical video representation of a real object or person, such as a dealer, cards and chips, for example.

The individual player positions preferably have a separate intelligence at each player position that accepts player input and communicates directly with a game engine (main game computer or processor). The intelligence is preferably an intelligent board that can process information. For purposes of this disclosure the term "intelligent" refers to the ability to execute code, either provided in the form of software or hardware circuits. Such processing may at least comprise some of signal converting (e.g., signals from player card readers, credit deposit, currency readers, coin readers, touch screen signals, control panel signals) into a signal that can be included in an information packet and interpreted by the main game computer when the signal is sent. Communication between the intelligence at each player position is direct to the main game computer and may be by self-initiated signal sending, sequenced polling by the main game computer (e.g., each position communicates directly to the main game computer in turn), timed communication, or any other order of communication that is direct between the intelligence and the main game computer.

One preferred form of communication between the main game computer and player station computers is by means of self-initiated signal sending. There is essentially a single main game computer that contains video display controls and programs for both the dealer display and the table top display, audio controls and programs, game rules (including storage of multiple games if intended to be available on the machine), random number generator, graphic images, game sequence controls, security systems, wager accounting programs, external signaling and audit functions, and the like. In other forms of the invention, the above functions are divided between a main processor and one or more additional processors. The intelligence at each player position speeds up the performance of all aspects of the game by being able to communicate directly with the main game computer and being able to process information at the player position rather than merely forwarding the information in raw form to the main game computer. Processing player information at player positions frees up resources for use by the main processor or processors.

A card game system may also include a suitable data and control processing subsystem that is largely contained within a main control module supported beneath the tabletop. The control and data processing subsystem includes a suitable power supply for converting alternating current from the power main as controlled by a main power switch. The power supply transforms the alternating line current to a suitable voltage and to a direct current supply. Power is supplied to a power distribution and sensor/activity electronics control circuit. Commercially available power switching and control circuits may be provided in the form of a circuit board which is detachable, and plugs into a board receptacle of a computer mother board or an expansion slot board receptacle. A main game controller motherboard may include a central microprocessor and related components well-known in the industry as computers using Intel brand Pentium® microprocessors and related memory or intelligence from any other manufacturing source. A variety of different configurations and types of memory devices can be connected to the motherboard as is well known in the art. Of particular interest is the inclusion of two flat panel display control boards connected in expansion slots of the motherboard. Display control boards are each capable of controlling the images displayed for the dealer video display and for each of the player position display areas on the continuous display screen on the table and other operational parameters of the video displays used in the gaming system. More specifically, the display control boards are connected to player bet interfaces circuits for the player stations. This arrangement also allows the display control boards to provide necessary image display data to the display electronic drive circuits associated with the dealing event program displays and the dealer display.

The motherboard and/or the individual player intelligent boards also includes a serial port that allows stored data to be downloaded from the motherboard to a central casino computer or other additional storage device. In one example, each player board communicates directly with the casino computer system. This allows card game action data to be analyzed in various ways using added detail, or by providing integration with data from multiple tables so that cheating schemes can be identified and eliminated, and player tracking can be maintained. Player performance and/or skill can be tracked at one table or as a compilation from gaming at multiple tables, as by using Bloodhound™ security software marketed by Shuffle Master, Inc., which may be incorporated into this automated gaming system. Additionally, player hand analysis can be performed. The motherboard and/or individual player intelligent boards may also have a keyboard connection port that can be used to connect a larger format keyboard to the system to facilitate programming and servicing of the system.

Although the preferred system shown does not require features illustrated for receiving automated player identification information, such features can alternatively be provided. Card readers such as used with credit cards, or other identification code reading devices can be added in the system to allow or require player identification in connection with play of the card game and associated recording of game action by one of the processors. Such a user identification interface, for example a card reader located at each player station, can be implemented in the form of a variety of magnetic card readers commercially available for reading user-specific identification information. The user-specific information can be provided on specially constructed magnetic cards issued by a casino, or magnetically coded credit cards or debit cards frequently used with national credit organizations such as VISA, MASTERCARD, AMERICAN EXPRESS, casino player card registry, banks and other institutions. The information could also be provided on other writable media, such as an RFID chip with writable memory, or bar coding, as just a few examples.

Alternatively, it is possible to use so-called smart cards to provide added processing or data storage functions in addition to mere identification data. For example, the user identification could include coding for available credit amounts purchased from a casino. As further example, the identification card or other user-specific instrument may include specially coded data indicating security information such as would allow accessing or identifying stored security information which must be confirmed by the user after scanning the user identification card through a card reader. Such security information might include such things as file access numbers which allow the central processor to access a stored security clearance code which the user must indicate using input options provided on displays using touch screen displays. A still further possibility is to have participant identification using a fingerprint image, eye blood vessel image reader, or other suitable biological information to confirm identity of the user that can be built into the table. Still further it is possible to provide such participant identification information by having the pit personnel manually code in the information in response to the player indicating his or her code name or real name. Such additional identification could also be used to confirm credit use of a smart card or transponder. All or part of the functions dedicated to a particular player station are controlled by the player station intelligence in one form of the invention. Additionally, each player station intelligence may be in communication with a casino accounting system.

It should also be understood that the continuous screen can alternatively be provided with suitable display cowlings or covers that can be used to shield display of card images from viewing by anyone other than the player in games where that is desirable. This shielding can also be effected by having light-orientation elements in the panel, and some of these light-orientation elements are electronically controllable. In this manner, the processor can allow general viewing of cards in games where that is desirable or tolerated, and then alter the screen where desired. These types of features can be provided by nanometer, micrometer or other small particulate or flake elements within a panel on the viewing area that are reoriented by signals from the processor. Alternatively, liquid crystal or photo chromatic displays can be used to create a screening effect that would allow only viewers at specific angles of view from the screen area to view the images of cards. Such an alternative construction may be desired in systems designed for card games different from blackjack, where some or all of the player or dealer cards are not presented for viewing by other participants or onlookers. Such display covers or cowlings can be in various shapes and configurations as needed to prevent viewing access. It may alternatively be acceptable to use a player-controlled switch that allows the display to be momentarily viewed and then turned off. The display can be shielded using a cover or merely by using the player's hands. Still further it is possible to use a touch screen display that would be controlled by touch to turn on and turn off. Similar shielding can be used to prevent others from viewing the display.

A review of the figures will assist in a further understanding of the invention.

FIG. 1 shows a fully automated gaming table 1 of the prior art, as disclosed in U.S. Patent Application 2003/0199316. The system 1 comprises a vertical upright display cabinet 2 and a player bank or station cluster arrangement 3. The vertical display cabinet 2 has a viewing screen 7 on which images of the virtual dealer are displayed. The top 8 of the player bank arrangement 3 has individual monitor screens 10 for each player position, as well and tabletop inserted coin acceptors 11, and player controls 12 and 13. There is a separate and larger dealer's hand screen 9 on which dealer cards are displayed in a format large enough for all players to view. Speakers 16*a* and 16*b* are provided for sound transmission and decorative lights 14 are provided.

Figure 2:
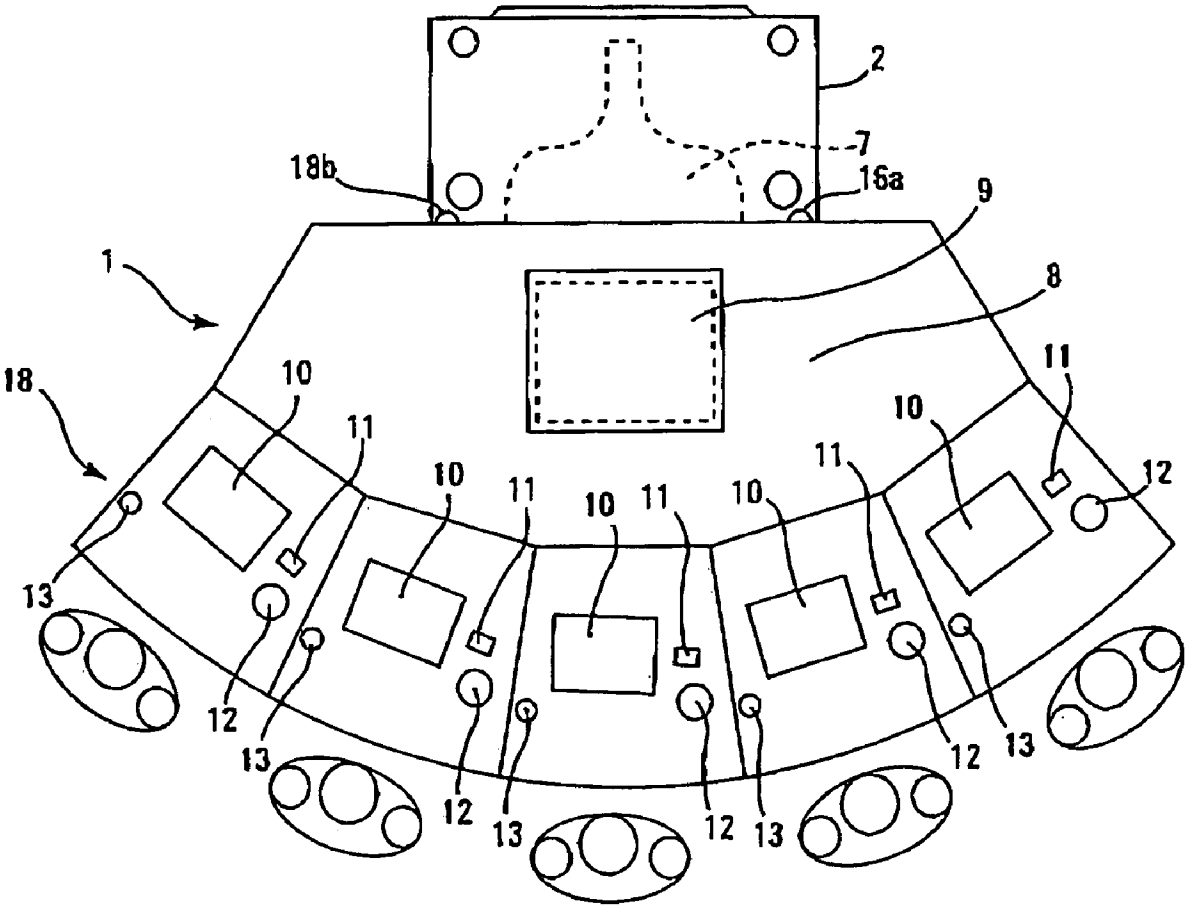
Fig. 2 Prior Art
FIG. 2 shows an overhead view of a prior art format for an automated gaming system.
Figure 3:
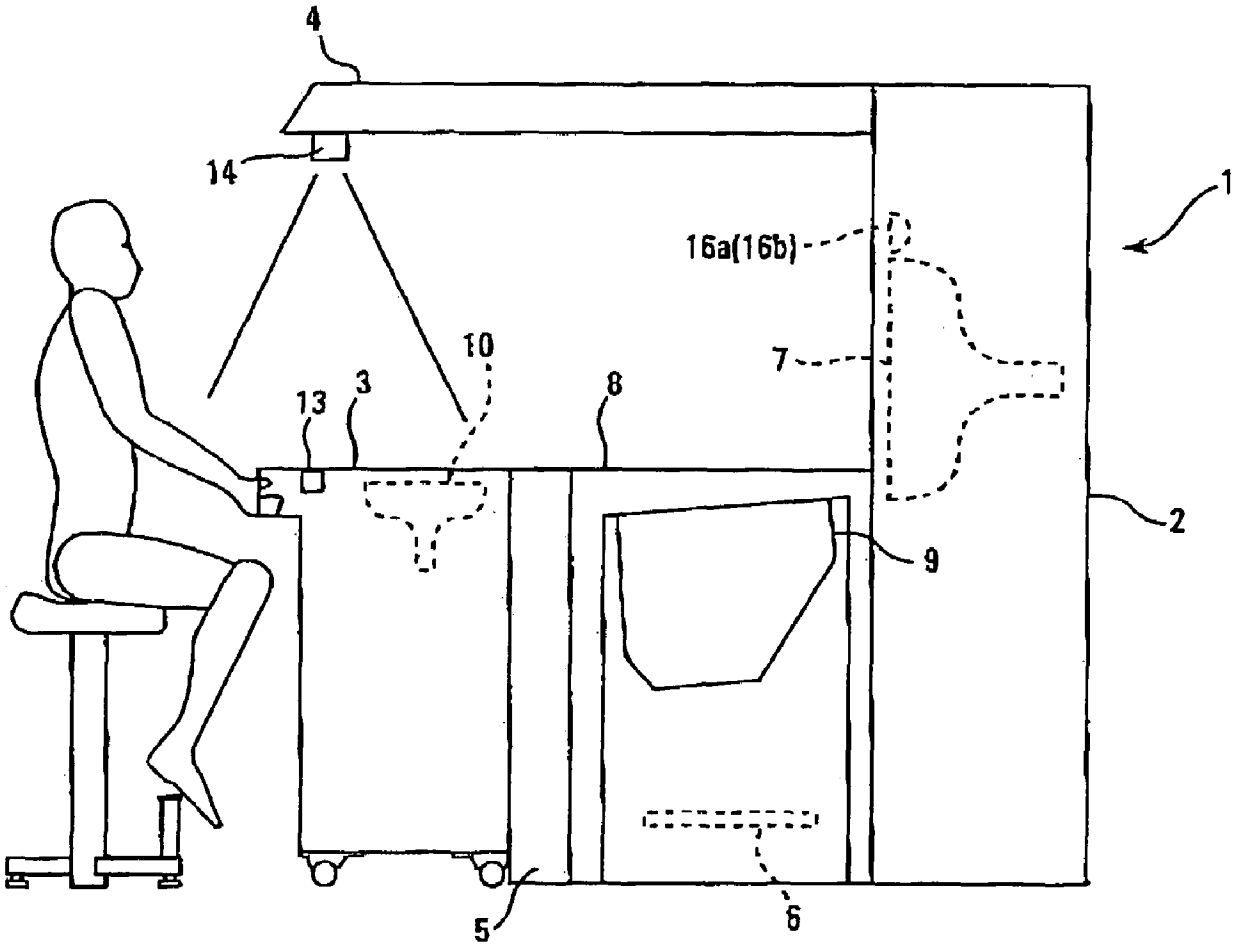
Fig. 3 Prior Art
FIG. 3 shows a side view of a prior art format for an automated gaming system.

FIG. 2 shows an overhead view of the same prior art automated gaming system 1 with the viewing screen 7 shown more clearly as a CRT monitor. It can also be seen that each player position has to form an arc cut into the semicircular player seating area 18. FIG. 3 shows a side view of the same prior art automated gaming system of FIGS. 1 and 2 where the orientation of the three different types of CRT monitors 7, 9 and 10 are shown.

Figure 4:
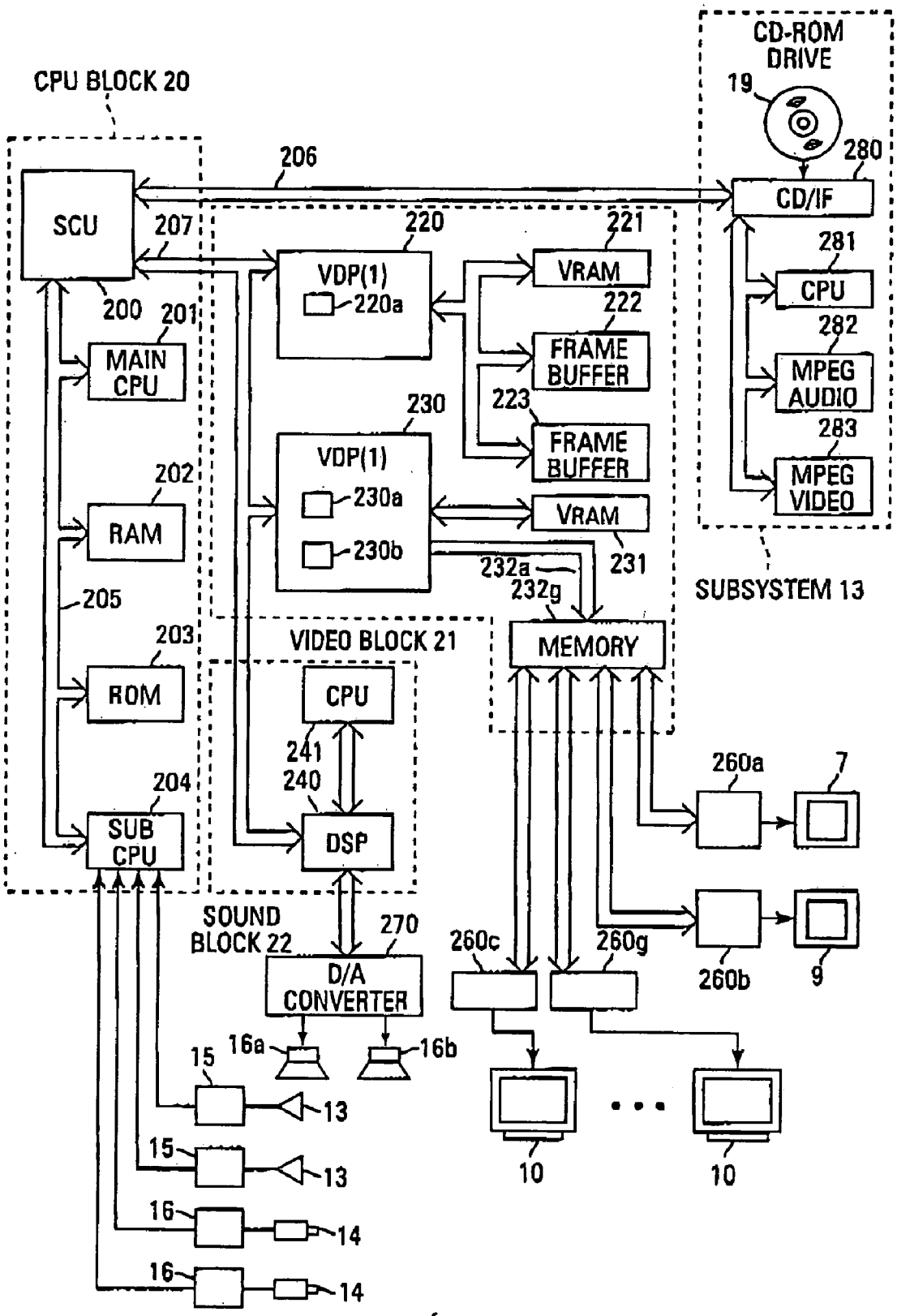
Fig. 4 Prior Art
FIG. 4 shows a block schematic of the electronic configuration of a prior art animated gaming system.

FIG. 4 shows the schematic circuitry of a prior art automated system as disclosed in U.S. Patent Application Publication No. 2003/0199316. FIG. 4 is a block diagram of processing circuitry in the game device of FIG. 1. The game device housing comprises a CPU block 20 for controlling the whole device, a picture block 21 for controlling the game screen display, a sound block for producing effect sounds and the like, and a subsystem for reading out CD-ROM.

The CPU block 20 comprises an SCU (System Control Unit) 200, a main CPU 201, RAM 202, RAM 203, a sub-CPU 204, and a CPU bus 205. The main CPU 201 contains a math function similar to a DSP (Digital Signal Processing) so that application software can be executed rapidly.

The RAM 202 is used as the work area for the main CPU 201. The RAM 203 stores the initialization program used for the initialization process. The SCU 200 controls the busses 205, 206 and 207 so that data can be exchanged smoothly among the VEPs 220 and 230, the DSP 241, and other components.

The SCU 200 contains a DMA controller, allowing data (polygon data) for character(s) in the game to be transferred to the VRAM in the picture block 21. This allows the game machine or other application software to be executed rapidly. The sub-CPU 204 is termed an SMPC (System Manager & Peripheral Control). Its functions include collecting sound recognition signals from the sound recognition circuit 15 or image recognition signals from the image recognition circuit 16 in response to requests from the main CPU 201. On the basis of sound recognition signals or image recognition signals provided by the sub-CPU 204, the main CPU 201 controls changes in the expression of the character(s) appearing on the game screen, or performs image control pertaining to game development, for example. The picture block 21 comprises a first VDP (Video Display Processor) 220 for rendering TV game polygon data characters and polygon screens overlaid on the background image, and a second VDP 230 for rendering scrolling background screens, performing image synthesis of polygon image data and scrolling image data based on priority (image priority order), performing clipping, and the like. The first VDP 220 houses a system register 220*a*, and is connected to the VRAM (DRAM) 221 and to two frame buffers 222 and 223. Data for rendering the polygons used to represent TV game characters and the like is sent to the first VDP 220 through the main CPU 220, and the rendering data written to the VRAM 221 is rendered in the form of 16- or 8-bit pixels to the rendering frame buffer 222 (or 223). The data in the rendered frame buffer 222 (or 223) is sent to the second VDP 230 during display mode. In this way, buffers 222 and 223 are used as frame buffers, providing a double buffer design for switching between rendering and display for each individual frame. Regarding information for controlling rendering, the first VDP 220 controls rendering and display in accordance with the instructions established in the system register 220*a* of the first VDP 220 by the main CPU 201 via the SCU 200.

The second VDP 230 houses a register 230*a* and color RAM 230*b*, and is connected to the VRAM 231. The second VDP 230 is connected via the bus 207 to the first VDP 220 and the SCU 200, and is connected to picture output terminals Voa through Vog through memories 232*a* through 232*g* and encoders 260*a* through 260*g*. The picture output terminals Voa through Vog are connected through cables to the display 7 and the satellite displays 10.

Scrolling screen data for the second VDP 230 is defined in the VRAM 231 and the color RAM 230*b* by the CPU 201 through the SCU 200. Information for-controlling image display is similarly defined in the second VDP 230. Data defined in the VRAM 231 is read out in accordance with the contents established in the register 230*a* by the second VDP 230, and serves as image data for the scrolling screens that portray the background for the character(s). Image data for each scrolling screen and image data of texture-mapped polygon data sent from the first VDP 220 is assigned display priority (priority) in accordance with the settings in the register 230*a*, and the final image screen data is synthesized.

Where the display image data is in palette format, the second VDP 230 reads out the color data defined in the color RAM 230*b* in accordance with the values thereof, and produces the display color data. Color data is produced for each display 7 and 9 and for each satellite display 10. Where display image data is in RGB format, the display image data is used as-is as display color data. The display color data is temporarily stored in memories 232*a*-232*f* and is then output to the encoders 260*a*-260*f*. The encoders 260*a*-260*f* produce picture signals by adding synchronizing signals to the image data, which is then sent via the picture output terminals Voa through Vog to the display 7 and the satellite displays 10. In this way, the images required to conduct an interactive game are displayed on the screens of the display 7 and the satellite displays 10.

The sound block 22 comprises a DSP 240 for performing sound synthesis using PCM format or FM format, and a CPU 241 for controlling the DSP 240. Sound data generated by the DSP 240 is converted into 2-channel sound signals by a D/A converter 270 and is then presented to audio output terminals Ao via interface 271. These audio output terminals Ao are connected to the input terminals of an audio amplification circuit. Thus, the sound signals presented to the audio output terminals Ao are input to the audio amplification circuit (not shown). Sound signals amplified by the audio amplification circuit drive the speakers 16*a* and 16*b*. The subsystem 23 comprises a CD-ROM drive 19*b*, a CD-I/F 280, and CPU 281, an MPEG-AUDIO section 282, and an MPEG-PICTURE section 283. The subsystem 23 has the function of reading application software provided in the form of a CD-ROM and reproducing the animation. The CD-ROM drive 19*b* reads out data from CD-ROM. The CPU 281 controls the CD-ROM drive 19*b* and performs error correction on the data read out by it. Data read from the CD-ROM is sent via the CD-I/F 280, bus 206, and SCU 200 to the main CPU 201 that uses it as the application software. The MPEG-AUDIO section 282 and the MPEG-PICTURE section 283 are used to expand data that has been compressed in MPEG (Motion Picture Expert Group) format. By using the MPEG-AUDIO section 282 and the MPEG-PICTURE section 283 to expand data that has been compressed in MPEG format, it is possible to reproduce motion picture. It should be noted herein that there are distinct processor for the CPU block, video block, sound block, CD-ROM drive and Memory with their independent PCU's. This requires significant computing power and still has dumb (no intelligence) player input components.

Figure 5:
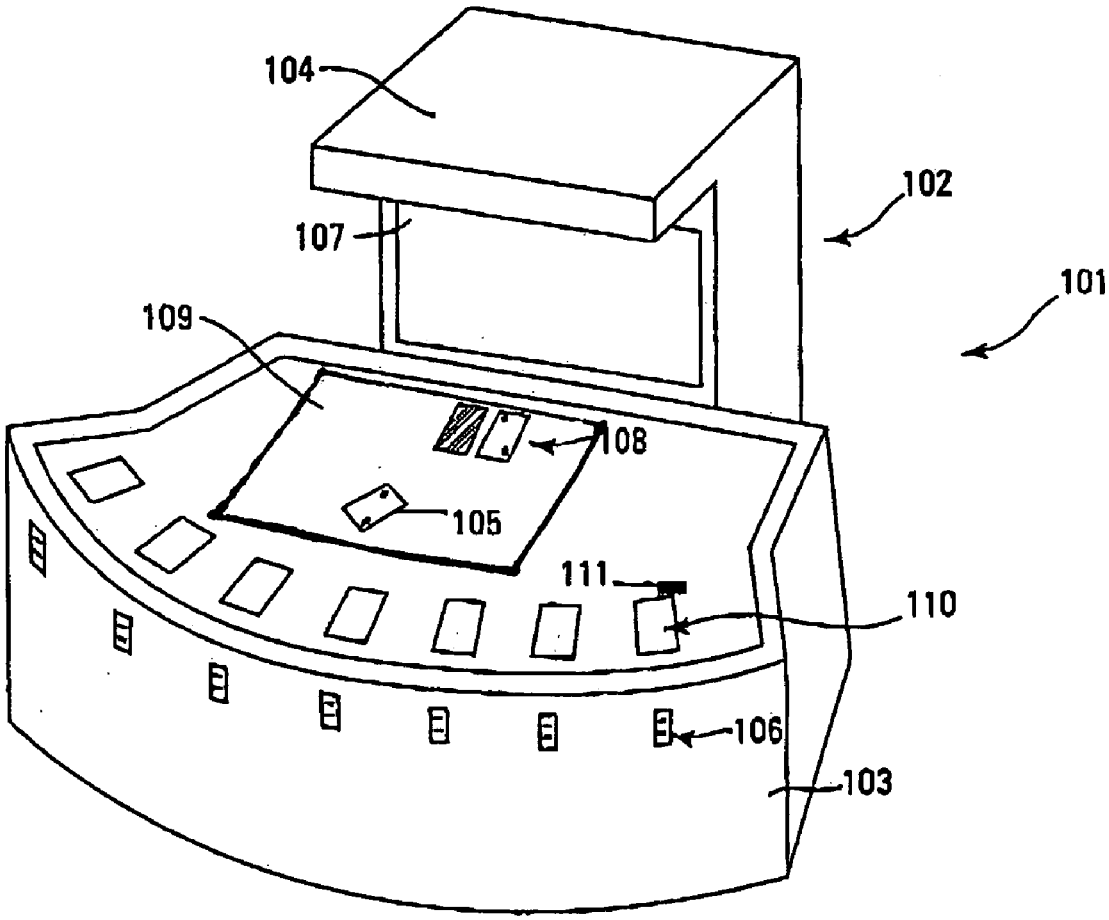
FIG. 5 shows a perspective view of a format for an automated gaming system according to the present invention.

FIG. 5 shows an example of an automated table system 101 useful to practice the game play methods of the present invention. The system 101 has an upright dealer display cabinet 102 with a top 104 and the dealer viewing screen 107 which may be any form of display screen such as a CRT, plasma screen, liquid crystal screen, LED screen or the like. The player bank arrangement 103 has a continuous display screen 109 on which images of cards being dealt 105, dealer's cards 108, bets wagered 111 and touch screen player input functions 110 are displayed. Other player input functions may be provided on a panel 106 which might accept currency, coins, tokens, identification cards, player tracking cards, ticket in/ticket out acceptance, and the like.

Figure 6:
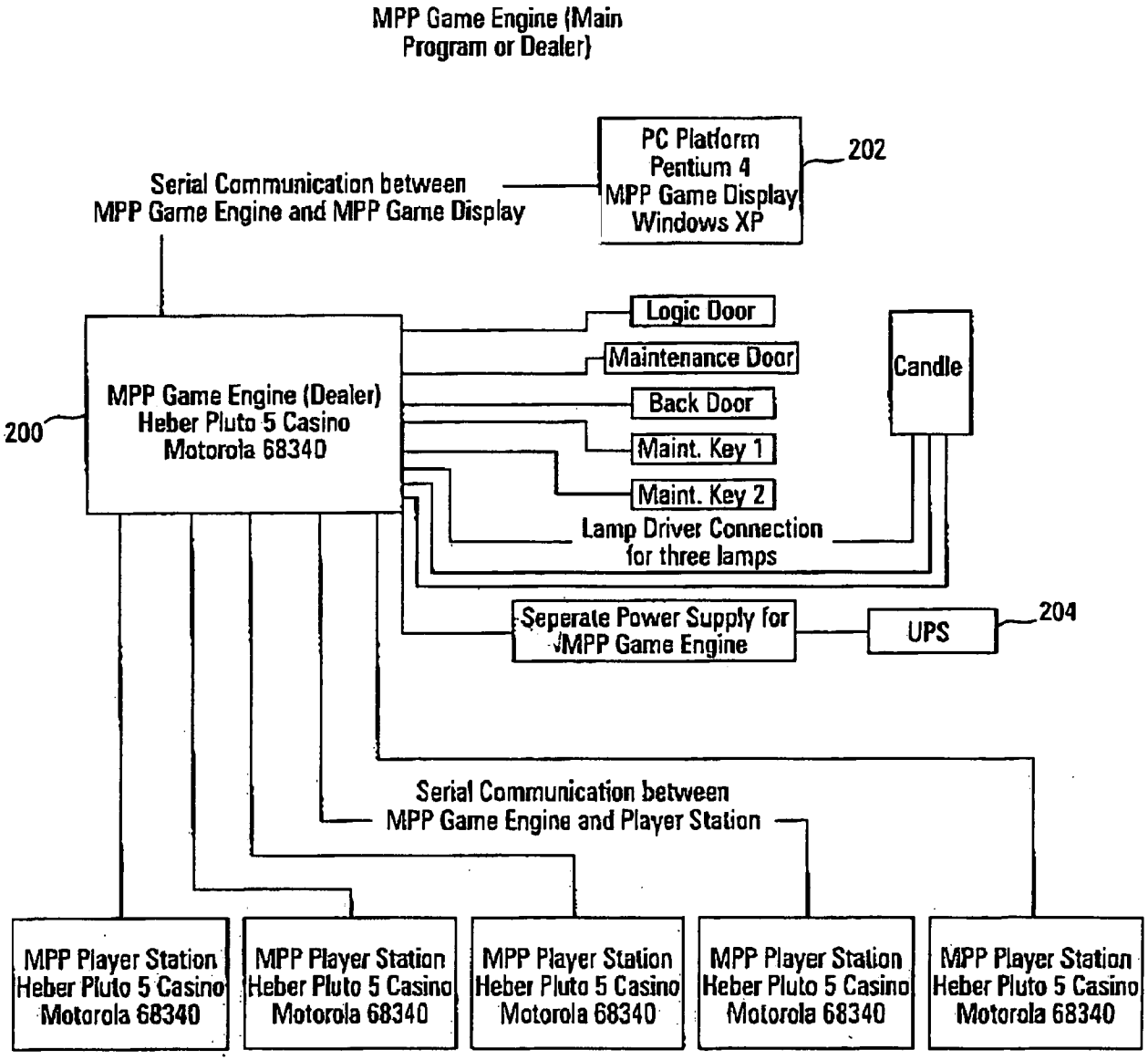
FIG. 6 shows a frontal view of a gaming engine useful in the practice of the present invention.

FIG. 6 shows an electronic/processor schematic for a MultiPlayer Platform (MPP) gaming system according to the presently described system. The MPP Game engine (dealer) comprises a Heber Pluto 5 casino game board 200 (Motorola 68340 board) operating off the PC Platform Pentium® 4 MPP Game Display processor 202. The game display processor operates on a Windows XP platform. The respective subcomponents on the Pentium 4 processor are labeled to show the apportionment of activity on the motherboard and the component parts added to the board. As is shown, the game engine has an Uninterruptible Power Supply 204. The game display processor directs activity on the Speakers, directs activities onto the MPP Game Service panel, and the Plasma Monitor Card Table display. It is important to note that all communications are direct from the game display processor, freeing up resources available to the game engine processor.

Figure 7:
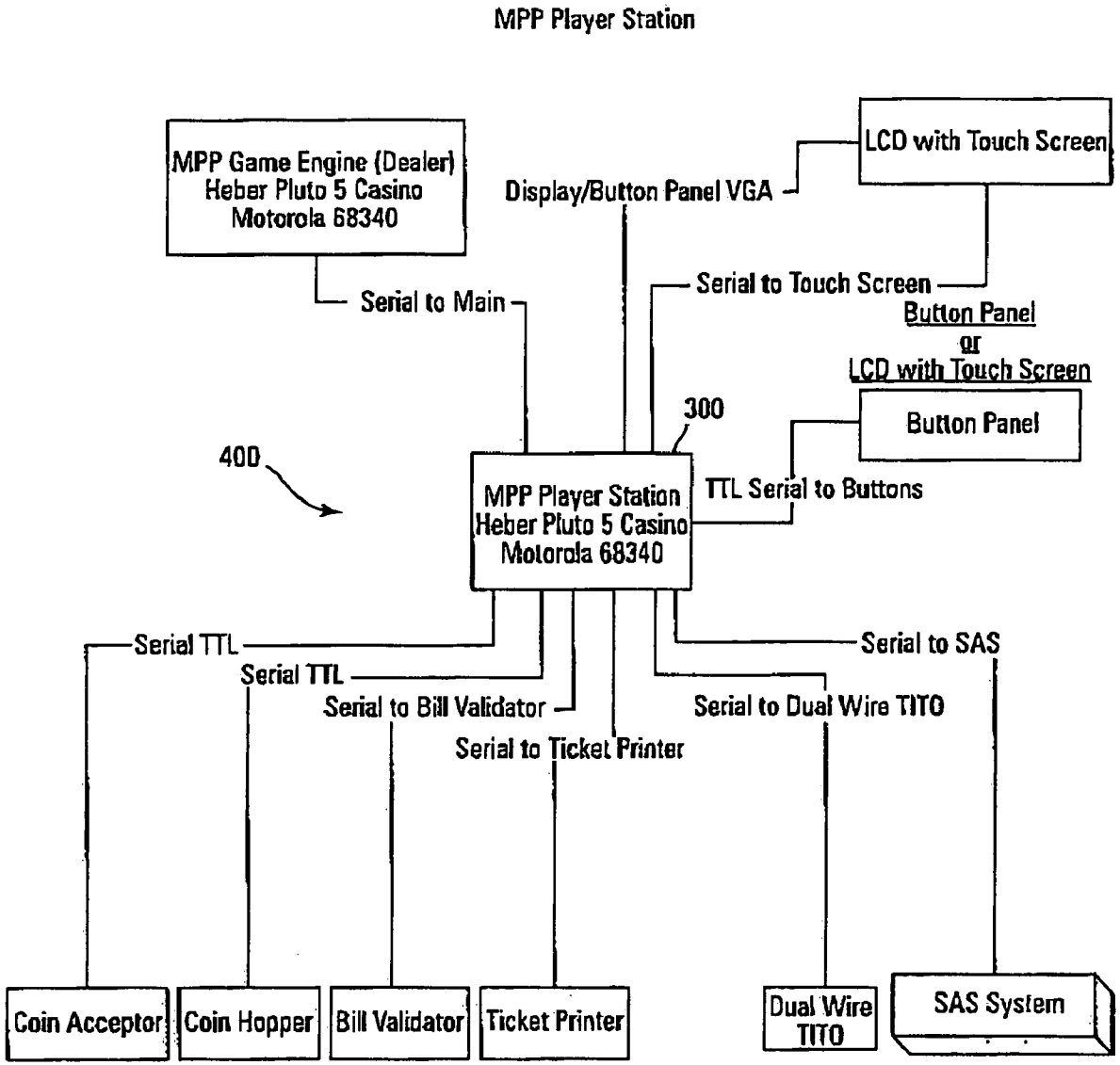
FIG. 7 shows a schematic of a player station useful in the practice of the present invention.

FIG. 7 shows the electronic/processing schematics of the MPP Player Station Intelligence board (Heber Pluto 5 Casino, Motorola 68340), each of which player stations (one for each player position) is in direct connection to the MPP Game Engine (Dealer), which is in turn directly connected to the PC Platform. (not shown in this Figure). Each Intelligence board receives information for all player input systems specific to that player station, such as the shown Coin Acceptor, Coin Hopper, Bill validator, Ticket Printer, Touch Screen and/or Display Button Panel, Dual Wire Ticket-in-Ticket-Out Printing and SAS System (SAS is one exemplary standard communications protocol used by a number of casinos central computer systems.) A significant benefit resides in the use of the independent Intelligence boards at each player position being in direct communication with the MPP Game Engine 300, as opposed to each individual player position button panel being dead or inactive until authorized by the main game processor, as previous automated gaming systems were constructed.

The above-described architecture is also an improvement in providing a system with not only the intelligence at each player position, but also in redistributing processing capability for functions among various processing components within the gaming system. In one architectural format, all functions of the gaming engine, except for the player localized intelligence functions, are consolidated into a single PC (e.g., the Pentium 4 shown in the Figures). This would include all game functions, player video functions, dealer video functions, dealer audio functions, security, central reporting (to a casino's central computer, for example), currency and debit functions, alarm functions, lighting functions, and all other peripherals on the system, except for the localized player functions. Alternatively, all functions requiring communication with the casino's main computer system are located on the player station intelligent boards. In this system, the main game processor would talk directly with the player intelligent boards, preferably in the same novel communication format described below.

Figure 8:
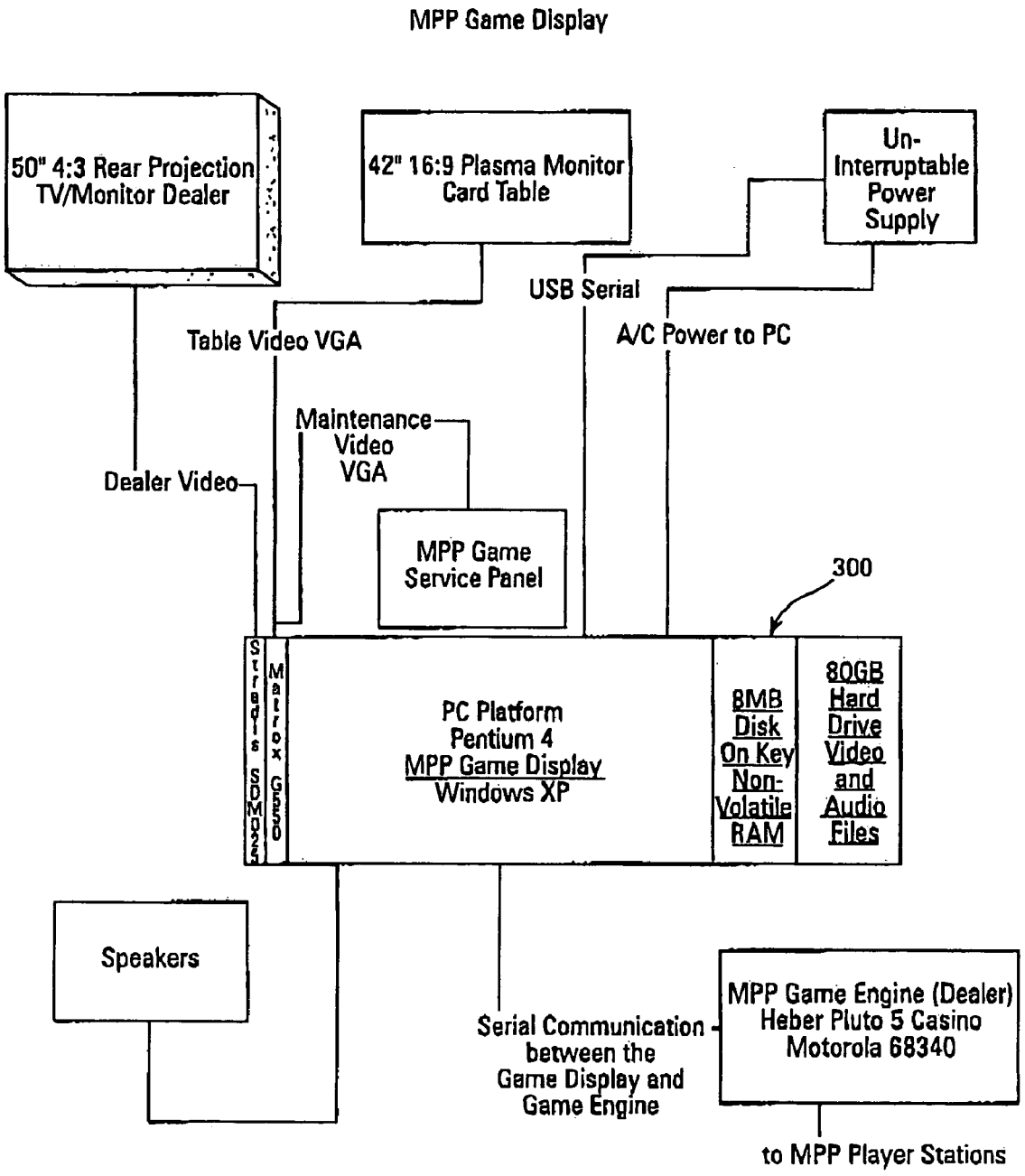
FIG. 8 shows a schematic of a preferred embodiment of a game display useful in the practice of the present invention.

An alternative system is shown in FIGS. 6, 7 and 8, where there is a dealer engine processor intermediate the main game PC and the Player intelligent boards. Both systems are a distinct improvement over the prior art, but with the higher power available for PC's, and with the ease of programming a PC as opposed to an embedded system, the consolidation of the game functions and the ability of the main game engine to communicate with each of the player positions is enabled. As shown in FIG. 8, the Game display processor 300 is preferably a Pentium® 4 PC and is separate from the main processor. With the player intelligent boards, the main game PC can receive packets of information from each player station as events occur rather than having to poll each player position on a regular basis 100 times to gain the specific information for each player input that may be made.

A description of the Heber Board, (an exemplary board that can be used as a player station processor and/or game engine processor 16) a commercially available intelligent processing board is as follows. The Heber Board is known for its reliability and flexibility, especially for the Pluto 5 family of gaming products. The Pluto 5 is the controller of choice for the global gaming industry. Flexibility comes from a set of features built into the Pluto 5 (Casino) controller, and from the choice of optional add-on boards that can be used to adapt the Pluto family to best suit individual applications. In the area of interfacing, there are three distinct boards, each of which serves a particular function in helping the Pluto 5 to connect with the world outside:

RS485 Board

RS485 is an industrial-grade board for linking multiple systems in unforgiving circumstances for centralized information gathering. The Heber RS485 board is fully opto-isolated to provide complete circuit safety when used within 'electrically noisy' environments. The RS485 board uses a single RS232 connection to the Pluto 5 board and all necessary power is also derived through this link. Two header connectors may be provided for the RS485 channel to allow daisy chain connections between multiple systems.

HII/ccTalk Board

This board specializes in communicating with industry standard note/coin acceptors and payout hoppers. Equipped with dual communication channels, each port is configurable to use either the HII format to connect with Mars® coin/note acceptors or the ccTalk format for Money Controls® hoppers. Both channels are controlled via a single RS232 connection to the Pluto 5 board and all necessary power is also derived through this link. The Heber FastTrack™ package contains modular library functions for passing information via these channels.

Four Channel Relay Board

The relay board allows control of medium- to high-level loads such as solenoids, without risk of damage or interference to the Pluto 5 circuitry. Four power-switching channels are available with absolute isolation from the Pluto 5 control signals. Each relay is capable of switching direct or alternating currents of up to 7A at a maximum voltage of 250V.

Like the Pluto 5 board itself, its modular options have been used extensively so that their designs are fully developed and entirely stable. The options that are specified are consistently provided in mass quantities. As with all Pluto products, programming for the modular options is straightforward. This is enhanced with the use of the Pluto 5 Enhanced Development Kit and also the FastTrack™ package. Between them, these kits contain all of the low level and high level programming tools and library functions needed for gaming applications. These systems can be provided through a Pluto 5 Enhanced Development Kit datasheet 80-15353-7 (Heber Limited, Belvedere Mill, Chalford, Stroud, Gloucestershire, GL6 8NT, UK Tel: +44 (0) 1453 886000 Fax: +44 (0) 1453 885013 www.heber.co.uk. Specifications for the various boards are identified below.

RS485 Interface

Host Interface
- RS232 connection to Pluto 5/Pluto 5 Casino
- All power provided via RS232 link from host system Communication Port
- Dual four-way Molex 0.1" KK headers for daisy chaining purposes Dimensions
- 80×61 mm (3.14×2.4")

Part Number
- Opto-isolated RS485 board 01-14536-2

HII/ccTalk Interface

Host Interface
- RS232 connection to Pluto 5/Pluto 5 Casino
- All power provided via RS232 link from host system Communication Port
- Single or dual 10 way header connectors Dimensions
- 101.6×69.85 mm (4×2.8")

Part Number
- Dual channel HII/ccTalk board 01-16171-2

Four Channel Relay Board

Host Interface
- Connection to Pluto 5/Pluto 5 Casino via ribbon cable using four standard output lines
- All power provided via ribbon cable link from host system Switching Capabilities
- Up to 250V AC or DC @ 7A maximum per channel Dimensions
- 80×61 mm (3.14×2.4")

Part Number
- Four channel relay board 01-15275-1

80-16949-1

One proposed hardware configuration uses a "satellite" intelligent processor at each player position. The player station satellite processor is substantially the same as the primary game engine processor, a Heber Pluto 5 Casino board. The satellite processors receive instruction from the primary game engine but then handle the communications with player station peripherals independently. Each satellite processor communicates with only the peripherals at the same player station. Thus each player station has a dedicated satellite processor communicating with only the peripherals at the same player station and with the casino's central computer system. The peripherals are, but not limited to: Slot accounting Systems, Bill Validator, Ticket Printer, Coin Acceptor, Coin Hopper, Meters, Button panel or LCD touch screen and various doors and keys.

The satellite processors run proprietary software to enable functionality. The player station software is comprised of two modules, the first being an OS similar to the game engine Operating System and the second being station software that handles peripheral communications. The software may be installed on EPROMs for each satellite processor. The primary method of communication between the satellite processors and the primary game engine is via serial connectivity and the previously described protocol. In one example, information packets are prepared by the satellite processors and are sent to the game engine processor on the happening of an event.

The proposed game engine provides communication to the player stations to set the game state, activate buttons and receive button and meter information for each player station. Communication is via a serial connection to each of the stations. The new protocol for communication between the game engine, game display and player stations is an event driven packet-for-packet bi-directional protocol with Cyclic Redundancy Check (CRC) verification. This is distinguished from the Sega system that used continuous polling. This communication method frees up resources in the same engine processor because the processor no longer needs to poll the satellites continuously or periodically.

The new protocol uses embedded acknowledgement and sequence checking. The packet-for-packet protocol uses a Command Packet, Response Packet and a Synchronization Packet as illustrated below. The protocol uses standard ASCII characters to send data and a proprietary verification method.

Format of Command Packet

| STX | SEQ | DATA LENGTH | DATA | CRC-16 | ETX |
|---|---|---|---|---|---|
| 1 | 1 | 3 | 3-999 | 5 | 1 |

Format of Response Packet

| STX | SEQ | DSP | PRV | ETX |
|---|---|---|---|---|
| 1 | 1 | 1 | 1 | 1 |

Format of Synchronization Response Packet

| STX | MTS | MRS | ETX |
|---|---|---|---|
| 1 | 1 | 1 | 1 |

Legend For Figures

| | |
|---|---|
| STX | Start of Packet Character |
| SEQ | Sequence # (Cycles from '0' thru '9') |
| LEN | Length of Data Area ('003' thru '999') |
| DATA | ASCII Data Fields Separated with '\|' Character |
| CRC | CRC-16 Value ('0000' thru '65535') Cyclic Redundancy Check |
| ETX | End of Packet Character |

-continued

Legend For Figures

| | |
|---|---|
| DSP | Disposition Code ('A' ACK, 'N' NAK, or 'I' Invalid Sequence) |
| PRV | Sequence Number of Last ACK'ed Packet (0 thru 9) |
| MTS | Main's Current Transmit Sequence Number |
| MRS | Main's Current Receive Sequence Number |

The Command Packet and Response Packet are used during primary game communications. The protocol uses redundant acknowledgement. For example: The packet is initially acknowledged when first received by the recipient. The same recipient will resend anther acknowledgement in the next communication. This second acknowledgement is the 'PRV' data in the response packet.

The communications between the Game Engine and the Player Station intelligence is preferably a transaction-based protocol. Either device can start a transaction, which is why it is essential that there be an intelligent board at each player position. All packets of information may be sent in any acceptable format, with ASCII format preferred as a matter of designer choice. All command packets usually contain a sequence number that is incremented after each successful packet exchange. The Game Engine and the Player Station intelligence use sequence numbers that are independent of each other. The sequence number keeps the communications in synchronization. This synchronization method is described later.

The command packet is used to send various commands such as Inputs, Lamps, Doors, Errors, Chirp, Game Results, player input, coin acceptance, player identification, credit acceptance, wagers, etc. . . . The command packet format may be, by ay of a non-limiting example:

<STX><Sequence number><Data Length><Data><CRC-16><ETX>

The data format with in the command packet may be:

<Address><Command><Field 1>|<Field 2>|<Field n>|

The response packet format may be:

<STX><Sequence number><Disposition><Previous ACK><ETX>

The sync request packet format may be:

<SYN>

The sync response packet format may be:

<STX><Mains Current Transmission Sequence><Mains Current Receive Sequence><ETX>

A major strength of the protocol is its resilience of the Game Protocol and its ability to free up resources within the game engine. Those resources can in turn be used to provide more intricate games, and multi-media affects.

Synchronization Method:

The satellite and host must become synchronized in order to provide for reliable communications using packet numbers. To facilitate this, a novel protocol synchronization method that is used. Upon applying power to the satellite, or after a communications failure, the satellite automatically enters into synchronization mode. In the synchronization mode the satellite sends out the ASCII SYN (0×16) character about every second. It is expecting a special response packet containing transmit and receive packet sequence numbers to be used from that point on. After receiving the special response packet, the sequence numbers are used as-is, and not incremented until a successful packet exchange is completed. After communications is synchronized, the sequence numbers are incremented after each packet is successfully sent or received.

As was noted before, the main game processor may contain information, data, programming and other necessary functions to enable the play of multiple games off the same machine. For example, the main game engine may have rules and commands that will enable play of high and low games of the present invention and other card games. The system may be controlled so that different games may be played at different times on command of the casino or players.

Figure 11:
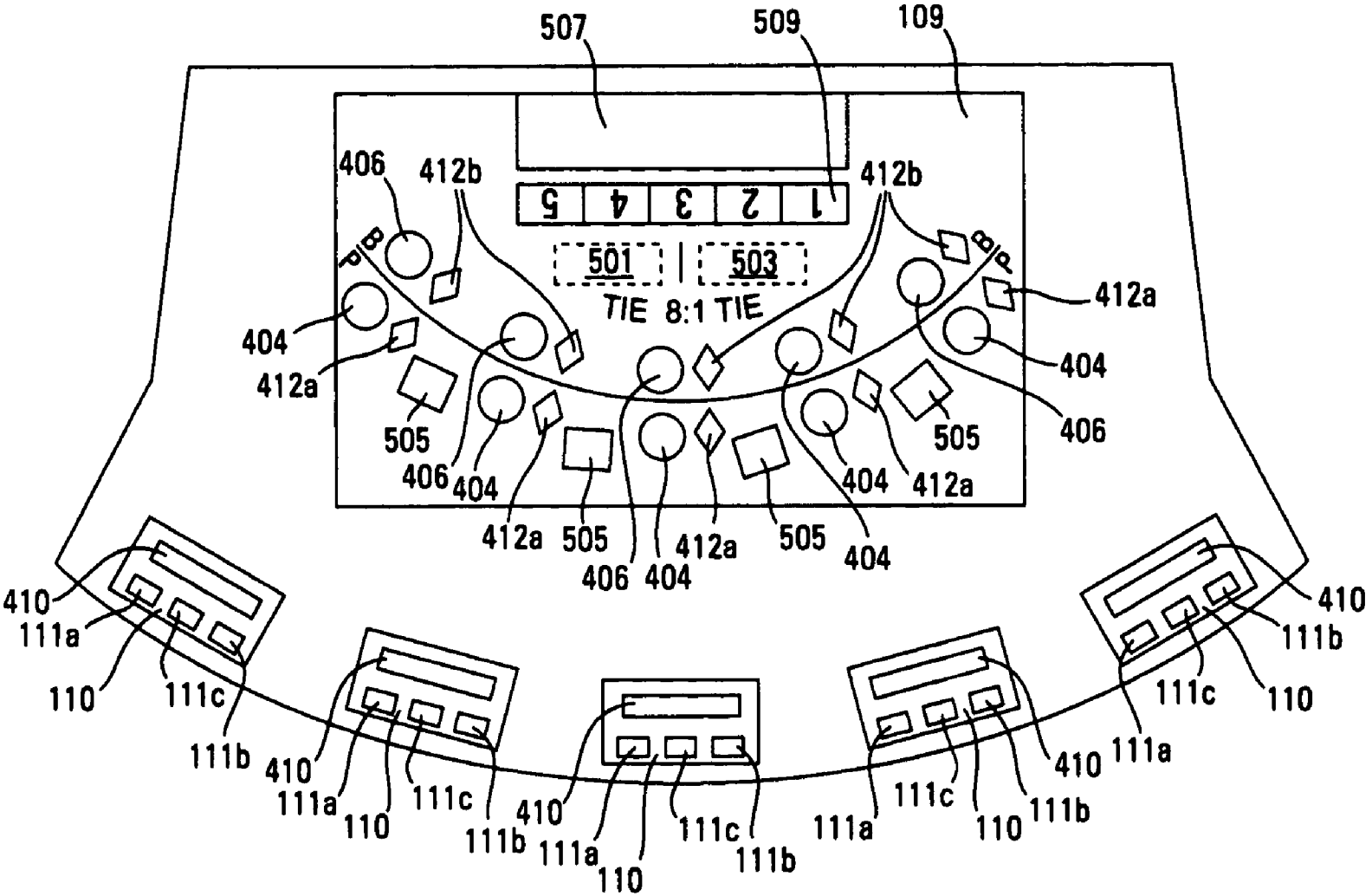
FIG. 11 is a top elevation view of an exemplary gaming table surface of a multiple player platform device, configured to execute the game play steps of Mini-Baccarrat with a Dragon Bonus side bet.

FIG. 11 is a top elevational view of an exemplary gaming table surface of the multiple player platform device of the present invention, configured to execute the game play steps of Mini-Baccarat with a Dragon Bonus Side Bet. The top surface includes a continuous video display screen 109 and multiple control panels 110. Each player control panel 110 includes multiple betting buttons 111*a*, 111*b*, 111*c* that allow the player to play the game. Alternatively, the apparatus uses touch screen controls.

The device preferably operates on credits. When the player presses the bet button 111*a* on the player hand baccarat game, the player hand wager betting circle 404 shows-chips in area 404 on the display screen 109. The gaming chips are removed from the virtual chip tray 507 (which may be omitted) when the player places currency or tickets in the coin and/or ticket acceptor (not shown) and are displayed in display area 404 (for the player hand), 406 (for the banker wager) and 412*a*, 412*b* (for the side bet wagers). Or if the player wants to bet on the banker hand, he depresses button 111*c* and his chip representation appears in betting circle 406. If the player chooses to place an optional wager on the Dragon Bonus side bet, he depresses button 111*b*, which causes wager to be displayed on the screen 109 in areas 412*a* or 412*b*. The control buttons work in similar fashion to a video poker machine. The player plays on credits of a single denomination and can wager multiples of that denomination on each bet in the primary game by depressing the betting buttons multiple times.

Players may refer to payout tables for the side bet by viewing pay table 505 displayed on the table. The pay table may be fixed, or the actual odds may become more liberal (or less liberal), depending upon variables external to the game rules. For example, the pay tables may become more liberal to the player when the player advances to higher wager amounts. In this sense, the pay tables may be considered dynamic. What is meant by "dynamic" is that the payout odds from game to game may vary according to variables external to the game rules such as the identity and/or rating of the player, the time of day, the play session duration, the particular dealer at the table, information the casino collected from the player during hotel registration, historical data on the player, comp credits issued to the player and a host of other possible variations.

The display 109 as shown in FIG. 11 can be readily seen by all players, and it is to be understood that the player control board 110, the wagering areas 404, 406, 412*a* and 412*b* are located at every player position. The player card area the pay table displays 501 and 505 are available to all players to view, but may or may not be displayed at each individual player location. The dynamic display could be present on the main screen 109, on a separate screen 410 or upright display, be located at each player location or between player locations. As long as the information is viewable to the player, the location of the dynamic display is unimportant.

The display 109 also includes a virtual chip tray 507 and an area 509 for keeping track of commissions payable to the house, as in a live game of mini baccarat.

The game includes a virtual dealer display 107 (shown in FIG. 5) that shows a representation of a human dealer that responds to the player controls and appears to administer the game by dealing cards, distributing chips, collecting bets and the like.

Although specific components, materials, sequences and rules have been provided in these descriptions to enable practice, it is clear to one skilled in the art that alternatives, variations, equivalents and the like may be used within the enabled scope of practice.

What is claimed:

1. A multi-player platform that provides multiple player positions for live players to engage in a baccarat game with a virtual dealer and virtual cards comprising at least two player positions that enable live players to place wagers on an underlying poker-type game, a display system for showing a virtual dealer, a display system for showing the virtual cards used in play of the underlying baccarat game, and a processor that contains the rules of the underlying baccarat game, the processor enabling play for each player on the underlying baccarat game according to the following rules:

a) a player selecting one of a player hand and a house hand and placing a base game bet on the selected hand to participate in a base game;

b) a player selecting one of a player hand and a house hand and placing a bonus game bet on the selected hand to participate in a bonus game;

c) a dealer dealing at least one player hand and the house hand according to a first set of game rules;

c) resolving the base card game according to the first set of game rules;

d) assigning a point value to both the player hand and the dealer hand according to a second set of game rules; and e) awarding the player a bonus payout when the selected bonus game hand has a point value that exceeds a point value of the other hand by a predetermined amount.

2. The platform of claim 1, wherein the first set of game rules is selected from the group consisting of baccarat, mini baccarat, war, three card poker and blackjack.

3. The platform of claim 1, wherein the first set of game rules comprises baccarat.

4. The platform of claim 1, wherein the second set of game rules comprises baccarat.

5. The platform of claim 1, wherein the first set of game rules and the second set of game rules are the same.

6. The platform of claim 1, wherein the base game bet is mandatory.

7. The platform of claim 1, wherein the base game bet is optional.

8. The platform of claim 1, wherein the bonus game bet is mandatory.

9. The platform of claim 1, wherein the bonus game bet is optional.

10. The platform of claim 1, wherein the base and bonus games are resolved according to the rules of baccarat and the predetermined point value is at least 5 points.

11. The platform of claim 1, wherein the base game is mini baccarat, and the bonus payouts are awarded according to the following schedule:

| Outcome | Player | Banker |
|---|---|---|
| Win by 9 Points | 30:1 | 30:1 |
| Win by 8 Points | 10:1 | 15:1 |

-continued

| Outcome | Player | Banker |
|---|---|---|
| Win by 7 Points | 9:1 | 9:1 |
| Win by 6 Points | 4:1 | 6:1 |
| Win by 5 Points | 1:1 | 1:1 |
| Natural Winner | 1:1 | 1:1. |

12. The platform of claim 1, wherein the house hand is a banker's hand.

13. The platform of claim 1, wherein the house hand is a dealer's hand.

14. A multi-player platform that provides multiple player positions for live players to engage in a baccarat game with a virtual dealer and virtual cards comprising at least two player positions that enable live players to place wagers on an underlying baccarat game, a display system for showing a virtual dealer, a display system for showing the virtual cards used in play of the underlying baccarat game, and a processor that contains the rules of the underlying baccarat game, the processor enabling play for each player on the underlying baccarat game according to the following rules with a virtual at least one, typical fifty-two card deck, the cards having standard rank and value, said game comprising the steps of:

a) a player selecting one of a player hand and a house hand and placing a base game bet on the selected hand to participate in a base game;

b) a player selecting one of a player hand and a house hand and placing a bonus game bet on the selected hand to participate in a bonus game;

c) a dealer dealing at least one player hand and the house hand according to a first set of game rules;

c) resolving the base card game according to the first set of game rules;

d) assigning a point value to both the player hand and the dealer hand according to a second set of game rules; and e) awarding the player a bonus payout when the selected bonus game hand has a point value that exceeds a point value of the other hand by a predetermined amount.

15. The platform of claim 14, wherein the first set of game rules is selected from the group consisting of baccarat, mini baccarat, war, three card poker and blackjack.

16. The platform of claim 14, wherein the first set of game rules comprises baccarat.

17. The platform of claim 14, wherein the second set of game rules comprises baccarat.

18. The platform of claim 14, wherein the first set of game rules and the second set of game rules are the same.

19. The platform of claim 14, wherein the base game bet is mandatory.

20. The platform of claim 14, wherein the base game bet is optional.

21. The platform of claim 14, wherein the bonus game bet is mandatory.

22. The platform of claim 14, wherein the bonus game bet is optional.

23. The platform of claim 14, wherein the base and bonus games are resolved according to the rules of baccarat and the predetermined point value is at least 5 points.

24. The platform of claim 14, wherein the base game is mini baccarat, and the bonus payouts are awarded according to the following schedule:

| Outcome | Player | Banker |
|---|---|---|
| Win by 9 Points | 30:1 | 30:1 |
| Win by 8 Points | 10:1 | 15:1 |
| Win by 7 Points | 9:1 | 9:1 |
| Win by 6 Points | 4:1 | 6:1 |
| Win by 5 Points | 1:1 | 1:1 |
| Natural Winner | 1:1 | 1:1. |

25. The platform of claim 14, wherein the house hand is a banker's hand.

26. The platform of claim 14, wherein the house hand is a dealer's hand.

* * * * *